US007479001B2

(12) United States Patent
Stroganov et al.

(10) Patent No.: US 7,479,001 B2
(45) Date of Patent: Jan. 20, 2009

(54) ROTOR SLIDING-VANE MACHINE WITH ADAPTIVE ROTOR

(76) Inventors: Alexander A. Stroganov, Stasovoy Street, 2-479, Saint Petersburg (RU) 195252; Yury M. Volkov, Zvenigorodskaya 28-3, Saint Petersburg (RU) 191119

( * ) Notice: Subject to any disclaimer, the term of this patent is extended or adjusted under 35 U.S.C. 154(b) by 316 days.

(21) Appl. No.: 11/379,586

(22) Filed: Apr. 21, 2006

(65) Prior Publication Data

US 2007/0207048 A1 Sep. 6, 2007

Related U.S. Application Data

(60) Provisional application No. 60/778,796, filed on Mar. 3, 2006.

(51) Int. Cl.
*F04C 2/344* (2006.01)

(52) U.S. Cl. ..... 418/228; 418/229; 418/230; 418/231; 418/232

(58) Field of Classification Search ..... 418/228, 418/229, 230, 231, 232
See application file for complete search history.

(56) References Cited

U.S. PATENT DOCUMENTS 1,236,399 A * 8/1917 Bowen ..... 418/230
3,348,494 A * 10/1967 Fischer ..... 418/231
4,425,088 A * 1/1984 Kaegi et al. ..... 418/229
5,429,084 A * 7/1995 Cherry et al. ..... 418/219
6,547,546 B1 * 4/2003 Stroganov et al. ..... 418/228
7,314,354 B2 * 1/2008 Stroganov et al. ..... 418/219
2006/0153717 A1 * 7/2006 Stroganov et al. ..... 417/477.1
2007/0212247 A1 * 9/2007 Stroganov et al. ..... 418/229

* cited by examiner

*Primary Examiner*—Thomas E Denion
*Assistant Examiner*—Mary A Davis
(74) *Attorney, Agent, or Firm*—Christopher L. Parmelee; Walker & Jocke LPA

(57) ABSTRACT

The invention can be used as a high pressure rotor vane pump or hydro motor.

Figure 1A:
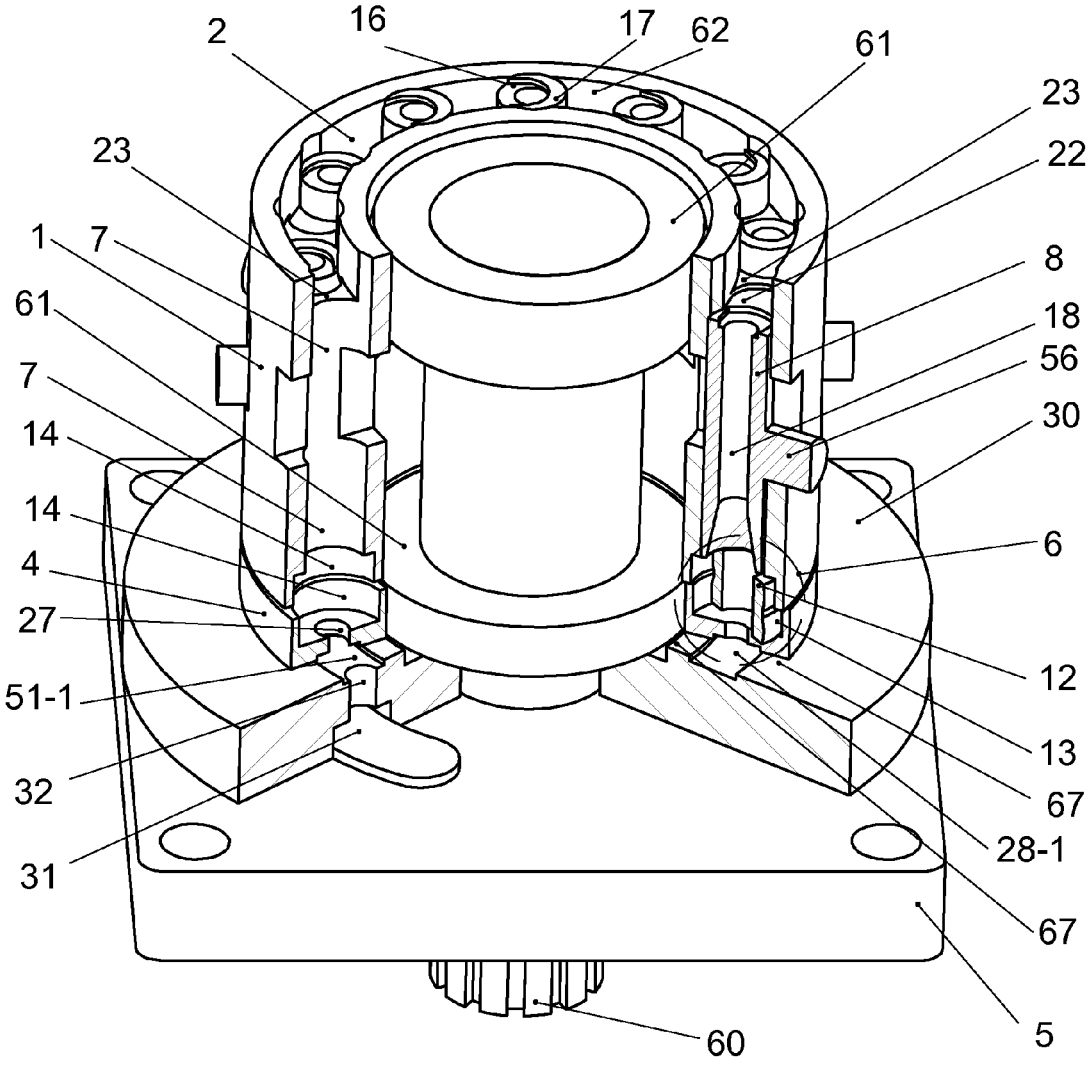

Rotor vane machine comprises a rotor including working and supporting parts connected via force chambers of variable length so that they rotate synchronously with a possibility of little reciprocal axial movements and tilts required to provide sliding insulating contact of face surfaces of the working and supporting pans of the rotor with the surfaces of the working and supporting cover plates of the housing correspondingly. Between the supporting cover plate of the housing and supporting part of the rotor there are made supporting cavities hydraulically connected via the means of local pressures balancing to the force chambers of variable length and cavities of the working chamber in the annular groove of the working part of the rotor. The losses on friction and cavitation decrease and the reliability increases.

24 Claims, 25 Drawing Sheets

View 1

View 2

ROTOR SLIDING-VANE MACHINE WITH ADAPTIVE ROTOR

The invention refers to mechanical engineering and can be used as a high pressure rotor sliding-vane machine with surgeless delivery that can work both in the mode of a pump and hydromotor of higher efficiency and reliability.

BACKGROUND OF THE INVENTION

To achieve a surgeless delivery and high efficiency a sliding-vane pump should have a constant cross-sectional area of the working chamber in the transfer area, low losses for leakages and friction, and no cavitation. The mentioned characteristics should be kept for all the operational range of the displacement alteration, pumping pressure and rotor rotational speed, and should little depend on the working fluid contamination and wear of the pump elements.

Allocation of the working chamber at the face of the rotor as, for example, in the pump US570584, provides for the desired constant cross-sectional area of the working chamber, combined well with pump displacement adjustment in U.S. Pat. No. 2,581,160, RU2123602 and U.S. Pat. No. 6,547,546.

Allocation of the working chamber in the annular groove at the face of the rotor of pumps U.S. Pat. No. 1,096,804, U.S. Pat. No. 3,348,494, US894391 and U.S. Pat. No. 2,341,710 provides for rotor radial unloading and rigid fixing of the vanes in the working chamber. The main sealings between reciprocally rotating parts in such a pump are transposed to the face surfaces of that part of the rotor where the annular groove is made and hereinafter referred to as the working part of the rotor, and to the corresponding face surfaces of the cover plate of the housing abutting to the mentioned annular groove and hereinafter referred to as the working cover plate of the housing. The mentioned sealing face surfaces of the rotor and of the housing can be made flat. Therefore, technological, thermal and other clearances between flat sealing surfaces can be easily taken up by forward oncoming movement of one sealing surface towards the other due to the pressing of the working part of the rotor to the working cover plate of the housing.

To provide the mentioned sealing it is required to overcome great pressure forces of the working fluid contained in the working chamber between the face of the rotor and the working cover plate of the housing in pumping and transfer areas tending to deform the working part of the rotor and the working cover plate of the housing and to force them out from each other.

Application of mechanical means of pressing without hydrostatical balancing in the pumps intended for generating high pressure in the pressure line is not efficient because of huge friction losses.

Patent EP0269474 describes a hydrostatic component (without specifying the ways of its installation into a pump) characterized by lower influence of axial rotor deformations on the quality of the sealings and by using the working fluid pressure for reciprocal pressing of the sealing surfaces of the rotor and housing. The rotor of hydrostatical component consists of two parts the authors call "vanes' holder" and "supporting flange". On the back face of the vanes' holder, opposite to the face with the annular groove, in the force chambers connected to the working chamber there are mounted piston-like elements sliding in axial direction and abutting the supporting flange. Thereby, the clearances between the housing the authors call "guideway carrier" and vanes' holder are taken up by axial movement of the mentioned piston-like elements out of force chambers of the vanes' holder. Working fluid pressure forces exerted against the vanes' holder from the side of the working chamber are transmitted via mentioned force chambers and piston-like elements to the mentioned supporting flange. But the described hydrostatical component does not provide for any means of hydrostatical balancing from the opposite side of the supporting flange. The authors point out that according to the essence of the invention the mentioned fluid pressure forces are compensated by flexible deformation of the mentioned flange making the vanes' holder free from axial deformations but the rotor as a whole remains hydraulically imbalanced.

According to the essence of the described by the authors of EP0269474 invention providing for unloading of the sealing pair of friction of the vanes' holder with the guideway carrier and transference of the forces to the static contact of the piston-like element with the deformable supporting flange, the mentioned static contact seals the force chamber and the vane chamber connected to it. When the vane axially moves out of the rotor the fluid goes to the vane chamber through the channels in the vane. Increase of rotor rotational speed and axial speed of the moving forward vane results in increasing of the pressure drop in the mentioned vane channels. If the pump is operated in a self-suction mode, i.e. inlet pressure is equal to the atmospheric pressure, at the certain speed of the rotor rotation hereinafter called the maximum speed of self-suction there appears cavitation in the vane chambers. Besides the increase of noise and pulsations the cavitation leads to significant losses of useful power and efficiency of the pump. Therefore cavitation effects are considered here in one line with the losses on friction at the face seals of the rotor and of the vanes as the factors of dissipative losses decreasing the efficiency of the pump. High tendency to cavitation and therefore low value of the maximum speed of self-suction is a significant disadvantage of the said hydrostatical component.

Patent EP0265333 describes an embodiment of hydrostatical differential gear with hydrostatical rotatory thrust block mounted between the back face of the vanes' holder and supporting flange rotating at different speeds. The mentioned hydrostatical rotatory thrust block is a simple thin ring rigidly fixed to the vanes' holder at rotation and provided with chambers located opposite the supporting flange. Each of the mentioned chambers is hydraulically connected via the calibrated orifice to the opposite force chamber on the basis of hydrostatical bearing principle the authors call "oil thrust block". Due to that pressure forces are transmitted to the supporting flange, and its deformation influences the leakages less than the similar deformation of the vanes' holder. The authors point out that deformations of the mentioned rotatory thrust block replicates deformations of the supporting flange. It means that pressure forces of the fluid acting on the rotatory thrust block from the side of the vanes' holder exceed the sum of pressure forces of the fluid from the side of the flange and elastic forces of the rotatory thrust block and cause an increase of deformation of the rotatory thrust block as long as deformation of the rotatory thrust block is sufficient for abutment to the supporting flange. In fact, principle of operation of the oil thrust block as a hydrostatical bearing assumes a dependence of the pressure in the rotatory thrust block chambers on correlation of the pressure drop on the calibrated orifice and pressure drop in the clearances between the supporting flange and rotatory thrust block. Therefore, as long as the mentioned clearances are large the pressure in the rotatory thrust block chambers is significantly lower than that in the force chambers, and due to this difference in the pressure forces the rotatory thrust block shifts closer to the supporting flange. With the decrease of the clearances the pressure in the rotatory thrust block chamber increases and becomes equal to the pressure in the force chamber which the rotatory thrust block chamber is connected to via a calibrated orifice at a complete absence of leakages from the oil thrust blocks only i.e. when the rotatory thrust block entirely abuts to the supporting flange. To achieve the mentioned abutment it is required to deform the rotatory thrust block in conformity with the flange deformation. For that it is required to provide significant hydrostatical imbalance of the rotatory thrust block.

The mentioned elastic deformation of the rotatory thrust block required for it's tight abutment to the supporting flange causes increasing of friction losses. When the flange is deformed by pressure forces of the fluid and the thrust block is abutted to the flange at first a partial reciprocal contact of the deformed flange and non-deformed thrust block appears followed by thrust block deformation. In this case elastic forces of the thrust block being overcome for its deformation cause proportionate friction losses between the rotatory thrust block and the supporting flange in the spots of partial contact. The mentioned thrust block is forced out from the flange by pressure forces of the fluid continuously distributed in insulating clearances, and it is pressed to the flange from the side of the force chambers by pressure forces distributed discretely, i.e. dropping to zero in the intervals between the force chambers. To provide good insulation when such method of pressing from the side of the force chambers is used the rotatory thrust block should be rigid enough. Therefore at significant pressures the said elastic forces of the deformed thrust block are great and the corresponding friction losses are significant.

To provide small leakages at zero or small clearances of micrometers order hydraulic resistance of the mentioned calibrated orifices should be comparable to the resistance of such microscopic clearances. It does not allow using the back face of the rotor for intake the fluid into the vane chambers via the cavities in hydrostatical thrust and the cavity in the housing. This, in its turn, does not allow to get rid of the above mentioned disadvantage of such machines, namely increased tendency to cavitation.

Besides, such use of hydrostatical bearing with calibrated orifices for decreasing friction forces results in lower reliability of the machines. Firstly, when suspended particles get into the fluid the mentioned microscopic calibrated orifices may become blocked up resulting in great increase of pressing forces of the thrust block and of the friction losses and speeding-up of wear. Secondly, in case of local defects on the sealing surfaces the leakages from the mentioned chambers of the rotatory thrust block increase and the pressure in the rotatory thrust block chambers drops. Tighter pressing due to the increasing difference of the pressures in this case does not reduce the leakages and result in balancing but rather causes greater losses on friction and quicker wear of the sealing surfaces. Volumetric efficiency can change insignificantly due to such an additional leakage from the chamber of the oil thrust block while the losses on friction can increase significantly.

For hydraulic balancing of the rotor of hydrostatical differential gear described in patents EP0269474 and EP0265333 the authors provide for a possibility to use a pair of hydrostatic components of the mentioned type in two embodiments.

The first embodiment has two guideway carriers mounted at the both sides of one central vanes' holder. The mentioned force chambers are made in the back part of the guideway carrier performing the function of the sliding seal fastened to the housing. In this case there is formed one whole rotor with two working chambers in two annular grooves on the opposite faces of the rotor similar to that described in details in the patent U.S. Pat. No. 3,348,494.

The second embodiment has two vanes' holders mounted at the both sides of one central guideway carrier. Vanes' holder via the force chambers bears against the supporting flanges that rigidly joint each other by means of a hollow cylindrical body forming a uniform rigid element the authors of patent EP0265333 call a "sealed crankcase".

In both embodiments of double machine the unit formed by two guideway carriers hereinafter shall be called stator unit or housing as the location of suction and pumping ports relative to it is not changed during the rotor rotation. The first of the described embodiments of double symmetrical machine hereinafter shall be called a machine with internal rotor or with force closure to the housing, while the second embodiment shall be called a machine with internal stator or with force closure to the rotor.

In both mentioned embodiments pressure forces of the working fluid exerted between the rotor and housing in pumping area in one working chamber are balanced in the second working chamber by reflection symmetric forces provided that both working chambers are made reflection symmetric relative to the plane perpendicular to the axis of rotor rotation.

In transfer areas axial balancing of the fluid pressure forces acting upon the rotor does not depend on working chambers symmetry only and requires special consideration.

In forward transfer zone at rotor rotation there arise and move closed transferred volumes separated from suction and pumping areas by sliding insulating contact of vanes with a forward transfer limiter, of vanes with vane chambers, of insulating surfaces of the rotor with the corresponding surfaces of the housing and by other clearances between the rotor, the vanes and the housing. Local pressure in each of the transferred volumes at other things being defined depends on the difference of the leakages entering this transferred volume and leaving it, depending in their turn on the character of abutment of the surfaces of all sliding contacts insulating the mentioned transferred volume for different rotation angles during its rotation. The character of abutment of the surfaces of the sliding insulating contact here and hereinafter means forms and hydraulic resistance of the clearances between such surfaces as functions of two parameters: rotation angle of the rotor and angular coordinate of the contact point relative to the chosen point of the housing. Individual character of abutment of each pair of surfaces in each machine is caused by technological inaccuracy during manufacturing and local defects appearing on the mentioned surfaces as a result of wear and resulting in spread of insulating clearances resistance in different areas of the housing and for different rotation angles of the rotor. The spread of resistance of clearances can lead to significant spread of local pressures arising in different transferred volumes. Similar statements are also true for backward transfer area.

The double symmetric machine described above with internal stator has no means of local pressures balancing in transfer areas, and transferred volumes in transfer areas of both symmetric working chambers are not connected to each other. Double symmetric machine with internal rotor U.S. Pat. No. 3,348,494 has channels in the rotor connecting symmetric vane chambers. But symmetric cavities formed in both annular grooves in transfer areas between the vanes are not connected to each other. Therefore, due to individual character of abutment of the surfaces of insulating contacts each working chamber has different local pressures in transfer areas and rotor balancing is not achieved. The mentioned variable difference of the pressure forces acting upon the rotor in two symmetric chambers results in proportional losses on friction in face seals. Arising local defects on sealing surfaces of the vanes, rotor or housing as a result of wear, for example, leads to greater spread of hydraulic resistance influencing local pressures in the transferred volumes. Even in case of minor change in total leakages insignificant for volumetric efficiency it results in greater amplitude of the mentioned variable difference of pressure forces, greater friction from the side of the smaller local pressure, i.e. from the side of larger wear, and speeding up of the further wear.

In the pump under patent U.S. Pat. No. 3,348,494 axial movement of the vanes in the rotor is provided by a special vanes drive mechanism rather than by springs. It consists of a cam slot mounted on the housing along which the side lobes of the vanes going through special driving windows in the rotor slide. One skilled in the art can find that such vanes drive mechanism should be hydraulically insulated from the working chambers.

Such embodiment of the vanes drive mechanism outside the working chamber reduces the losses on vanes friction against the surfaces of the housing but increases dependence of local pressures on the character of abutment of the surfaces of sliding insulating contact of the vanes with the walls of vane chambers providing hydraulic insulation of the vanes drive mechanism. Change of the mentioned character of abutment due to wear results in the increase of leakages between the cavities of the working chamber and the cavity where the mentioned drive mechanism is installed that leads to the spread of local pressures.

In both embodiments of double symmetric machines the vane moving out of the vane chamber in axial direction is substituted by the fluid coming through the channels in the vane itself. Therefore cavitation losses remain a significant disadvantage of such design.

Embodiment of the pump providing for hydraulic means of rotor balancing and being not a subject to cavitation in vane chambers is described in patent RU2215903. It describes reversible rotor machine containing two annular grooves forming working chambers at both faces of the rotor. Through openings for the vanes pierce both annular grooves. Each cover plate of the housing has axially movable forward transfer limiter the authors call "adjusting element" and backward transfer limiter the authors call "partition". The feature of the reversible machine is mutual antisymmetry of the two mentioned working chambers, and namely, that there is an adjusting element of the second working chamber mounted opposite the partition of the first working chamber, and a partition of the second working chamber mounted opposite the adjusting element of the first working chamber. "Working cavities" here understood by the authors as suction and pumping cavities of both chambers located in axial direction opposite each other are connected to each other by channels. Thus, the suction cavity of the first working chamber is connected to the pumping cavity of the second working chamber located opposite to it, and the pumping cavity of the first working chamber is correspondingly connected to the suction cavity of the second working chamber.

When the vane is moving out of the rotor into the suction cavity of the working chamber the fluid from the opposite pumping cavity of the other working chamber fills up the vacated volume in the vane chamber through the vane chamber of big cross-sectional area. So tendency for cavitation in the vane chambers is not characteristic for such a design.

When such machine is in operation there is high pressure set in one of the connected pairs of working cavities and low pressure in the second pair correspondingly. A possibility of hydrostatical rotor balancing in the zones of suction and pumping cavities location in such machine is evident.

In transfer areas due to antisymmetry of the working chambers there are different means of insulation and different configuration of the transferred volumes for opposite rotor faces. Between the rotor and the adjusting element there are formed confined in the annular groove transferred volumes insulated by the faces of the vanes sliding along the adjusting element. Between the rotor and partition located opposite the mentioned adjusting element there are formed confined in the vane chambers transferred volumes insulated by the sections of the bottom of the annular groove sliding along the mentioned partition. Distribution of the transferred volumes pressures and pressures in the clearances of the mentioned sliding insulating contacts depend on form and size of the mentioned clearances, i.e. on character of abutment of surfaces of the mentioned sliding insulating contacts of the sections of the annular groove bottom with a partition and of vanes with an adjusting element. Non-identity of pressure distribution at the opposite faces of the rotor generates variable differential forces acting upon the rotor in each transfer area even if the mentioned contacting surface is ideally flat.

Appearance, for example, as a result of wear, of local deflections from flat form, scratches and other local defects on the sealing surfaces of the adjusting elements, partitions, bottom of the annular groove, and vanes faces changes the character of abutment of the surfaces of the mentioned sliding insulating contacts thus changing the mentioned distribution of pressures and correlations of local pressures. That in its turn even in case of insignificant change of total leakages leads to significant increase of the amplitude of the mentioned variable differential pressures, increase of friction and quicker wear.

Provision of face sealing between the rotor and cover plates of the housing for both faces of the rotor by means of precise manufacturing only as in U.S. Pat. No. 3,348,494, for example, is not reasonable, as change of clearances resulting from thermal expansion, deformations and wear as a rule exceed permissible clearances in the seals operated at high pressures. So the structure of a rotor machine shall also include sealing elements movable in axial direction, for example, such as a guideway carrier with force chambers at the side opposite the guideway described in EP0269474. Their imbalance also leads to the corresponding losses on friction. Such movable sealing is described in more details below.

The means reducing the influence of the character of abutment of the surfaces of sliding insulating contacts in the working chamber on rotor balancing, a solution for overcoming the described tendency of such pumps to cavitation in vane chambers, and movable in axial direction sealing elements described in RU 2175731 taken by us for the closest analogue.

The mentioned patent describes a pump with a housing including working and supporting cover plates called "housing cover plates" in the patent. The face of the rotor located opposite the working cover plate of the housing has a cylindrical annular groove going through vane chambers called in the patent "openings in the rotor" with the vanes called in the patent "displacers". The surfaces of the rotor's face that has a cylindrical annular groove located at the both sides from this groove contact with a possibility of sliding along the faces of the sealing elements located opposite them and mounted in the slots on the working cover plate of the housing. The pump includes a backward transfer limiter, the patent calls a "partition" separating suction cavity from pumping cavity. Suction cavity is connected to inlet port the patent calls "inlet opening", while the pumping cavity is connected to outlet port the patent calls "outlet opening". The surfaces of the backward transfer limiter are in sliding contact with the rotor means of backward transfer insulation the patent calls "internal surfaces of cylindrical annular groove". Backward transfer limiter is fastened to the working cover plate of the housing and can form a single integral unit with it, but it is provided that in some embodiments of the pump backward transfer limiter can be mounted with a possibility to move in axial direction and interact with the means of its pressing to the rotor. The pump contains a vanes drive mechanism the patent calls "a mechanism setting axial arrangement of the displacers relative each other". Forward transfer limiter is formed by part of the internal surface of the working cover plate. For an adjustable embodiment of the machine the patent calls forward transfer limiter "movable in axial direction insulating element". The second face of the rotor contacts the supporting cover plate of the housing. The supporting cover plate of the housing of the pump provides for a possibility to mount a supporting-distributing member called in the invention "supporting-distributing disc". Supporting-distributing member can be mounted with a possibility to move along rotor's axis.

The mentioned supporting-distributing member contains supporting cavities also performing distributing functions and called in the patent "supporting-distributing cavities". Supporting-distributing cavities are located opposite suction and pumping cavities of the working chamber and the means of their insulation (insulating partitions)—opposite transfer areas providing insulation of these supporting cavities by means of the sliding contact with the adjacent back face surface of the rotor. Each supporting-distributing cavity is connected via channels made either in the housing or in the rotor including the vanes to the opposite suction or pumping area correspondingly. The dimensions and forms of the supporting-distributing cavities are similar to those of pumping and suction cavities in the working chamber correspondingly. Vane chambers in the rotor are made as through channels connecting in suction and pumping areas to the mentioned supporting-distributing cavities.

The mentioned through channels in the vanes or in the rotor simultaneously connected to the suction cavity of the working chamber in this case are parallel-connected to each other and to the channel in the housing via the mentioned supporting-distributing cavity. It provides for significant decrease of the pump's tendency to cavitation and for significant increase of the maximal self-suction speed.

Introduction of supporting-distributing member also contributes to a certain hydraulic balancing of the rotor. A possibility of balancing in pumping and suction areas is evident.

In transfer areas the similarity of distribution of pressures at the both faces of the rotor caused by the presence of the mentioned through channels in the rotor or in the vanes makes it possible to reduce the influence of the spread of insulating clearances in the working chamber and connected local pressures on the difference of counter pressure forces acting upon both faces of the rotor. But complete balancing of the rotor is not achieved due to different configuration of the rotor faces. Incomplete balancing of the rotor results in variable difference of pressure forces acting upon opposite faces of the rotor and causing proportional losses on friction in face seals.

Pressure distribution on the back side of the rotor in transfer areas is determined by the character of abutment of the surfaces of sliding insulating contact between the insulating dams of the supporting-distributing member and the rotor. Therefore, change of the mentioned character of abutment due to appearance of any deflections from the flat form or scratches on the sealing surfaces resulting, for example, from wear leads to significant disturbance of the mentioned similarity of pressure distribution. This in its turn even in case of insignificant change of total leakages leads to significant increase of the amplitude of the mentioned variable difference of pressure forces, greater friction and quicker wear.

Let us consider other components of loss on friction in face seals.

The internal surface of the supporting cover plate of the housing has a slot with at least one sealing element mounted in it with a possibility to move along the axis of the rotor rotation. The authors point out that supporting-distributing member the patent calls supporting-distributing disc can be used as such an element. Two sealing elements are mounted in the slots on the internal surface of the working cover plate of the housing with a possibility to move along the axis of the rotor rotation.

The mentioned sealing elements are made as hollow cylinders located in the annular slots on the internal surfaces of cover plates of the housing with a possibility to move along the axis of the rotor rotation. To provide the required pressing of the movable sealing elements to the surface of the rotor the mentioned elements are supported by special force chambers made inside the housing where an increased pressure is formed. In the described machine the role of such force chambers is performed by the mentioned annular slots. To create increased pressure in the mentioned annular force chambers the mentioned hollow cylinders have through channels connecting the annular force chamber to the area of leakages in the clearance of face sealing. The value of the increased pressure in the annular force chamber is determined by the form, dimensions and location of the mentioned channels.

The mentioned movable sealing element mounted on the housing in one cylindrical slot with the same pressure in the whole volume is subject to significant over pressing to the rotor in suction area and partially in transfer areas that causes excessive looses on friction.

The patent EP0269474 points out a possibility to make several force chambers insulated from each other in the housing. Different pressures are created in these chambers, therefore movable sealing element represented by a guideway carrier supported by these chambers can be well balanced hydrostatically in the pumping and suction areas. And because of two reasons in the forward and backward transfer zones the movable sealing element is acted upon from the side of the rotor by variable forces. Firstly, the area of the transfer zones at the edges of transfer zones connected to pumping or suction areas cyclically change. Secondly, the pressure in the transferred volumes of the working fluid in the process of their forward or backward transfer between the suction and pumping zones continuously changes and their position relative to the housing also continuously changes. As a result in the transfer zones there is formed complex, continuously changing pressure distribution acting from the side of the rotor upon the movable sealing element. To create symmetrical, continuously changing pressure distribution between movable sealing element and the housing it would be required to place infinite quantity of insulated from each other infinitely small force chambers each of them connected to the corresponding point in transfer zone and isolated from the adjacent force chamber. As practically realizable number of force chambers in the housing in transfer zone is limited to rather small numbers complete compensation of the variable forces acting upon movable sealing is not achieved. It leads to variable force of pressing of the surfaces of sliding insulating contacts of the rotor to the mentioned sealing elements of the housing.

Change of the character of abutment of surfaces of sliding insulating contact of the movable sealing element to the rotor because of occurrence of local defects of the sealing surfaces, for example, due to wear, leads to greater spread of hydraulic resistances determining local pressures in transferred volumes. This, in its turn, even in case of small change of total leakages leads to greater amplitude of the mentioned pressing force, increased friction and speeding up further wear.

The amplitude of this variable component achieving significant values determines the level of losses on friction inherent in the described above pumps with movable sealing fastened to the housing.

So all the solutions for hydrostatical balancing of the rotor and movable sealing considered above do not provide for complete balancing of the rotor and movable sealing. If the character of abutment of surfaces of sliding insulating contacts is not ideal, for example, when there appear local defects of sealing surfaces due to wear, there arise great forces of pressing in friction pairs between sealing elements of the rotor and housing. A need to provide for such great pressing forces determines relatively large width of the sliding insulating contact of the sealing shoulders of face seals and in its turn further increases the influence of local defects of sealing surfaces on disbalance of the pressure forces.

All the structures described above are characterized by increased dissipative losses decreasing their efficiency. The described means of decreasing friction by means of hydraulic balancing of the rotor and movable sealing do not lead to complete balance and are not resistant to the change of character of abutment of sealing surfaces of sliding insulating contacts due to appearance of local defects and contamination of the working fluid. Even the changes of leakages insignificant from the point of view of the influence on volumetric efficiency can cause significant decrease of mechanical and total efficiency.

ESSENCE OF THE INVENTION

The objective of the present invention is to create the means of hydrostatic balancing of the rotor and moving seal resistant to the wear of the elements of the machine and working fluid contamination and compatible with the means of overcoming cavitation in vane chambers and to increase the efficiency and reliability of rotor machines with the vanes in the groove.

To solve the formulated task the rotor is made adaptive, i.e. comprises two main parts: working and supporting performing the function of the moving seal. The working part of the rotor has vane chambers, and on its working face surface there is made an annular groove connected to the vane chambers with the vanes that are kinematically connected to the vanes drive mechanism mounted on the housing. The housing with inlet and outlet ports, containing supporting cover plate and working cover plate with a forward transfer limiter and a backward transfer limiter is connected to the rotor with a possibility of reciprocal rotation. Working cover plate of the housing is in sliding insulating contact with the working face surface of the working part of the rotor and forms a working chamber in the annular groove, the former being divided by the backward transfer limiter being in sliding insulating contact with the rotor means of backward transfer insulation and forward transfer limiter being in the sliding insulating contact with vanes into a suction cavity of the working chamber hydraulically connected to the inlet port and a pumping cavity of the working chamber hydraulically connected to the outlet port. Forward transfer limiter and vanes drive mechanism are made with a possibility to separate by vanes at least one inter-vane cavity of the working chamber from pumping and suction cavities.

The supporting cover plate of the housing is in sliding insulating contact with the supporting surface of the supporting part of the rotor lying opposite the working surface of the working part of the rotor. The supporting part of the rotor is kinematically connected to the working part of the rotor by an assemblage of rotor elements including force chambers of variable length so that to rotate synchronously with the working part of the rotor with a possibility to make axial travels and tilts at least sufficient to provide a sliding insulating contact of both said parts of the rotor with the corresponding cover plates of the housing. There are supporting cavities with insulating means made between the supporting cover plate of the housing and supporting part of the rotor. Each of the formed inter-vane cavities, as well as pumping cavity and suction cavity are hydraulically connected to at least one force chamber of variable length and to at least one supporting cavity via the means of local pressures balancing. Forms, dimensions and location of the supporting cavities and means of insulation are chosen so that the working fluid pressure forces repelling the working part of the rotor from the working cover plate of the housing are substantially equal and directed opposite to the pressure forces of the working fluid repelling the supporting part of the rotor from the supporting cover plate of the housing. Force chambers of the variable length are made so that at any angle of the rotor rotation the pressure forces of the working fluid contained in the force chambers of variable length substantially balance the said pressure forces of the working fluid repelling the said parts of the rotor from the corresponding cover plates of the housing providing just a small pressing required for insulation.

LIST OF DRAWINGS

Figure 1B:
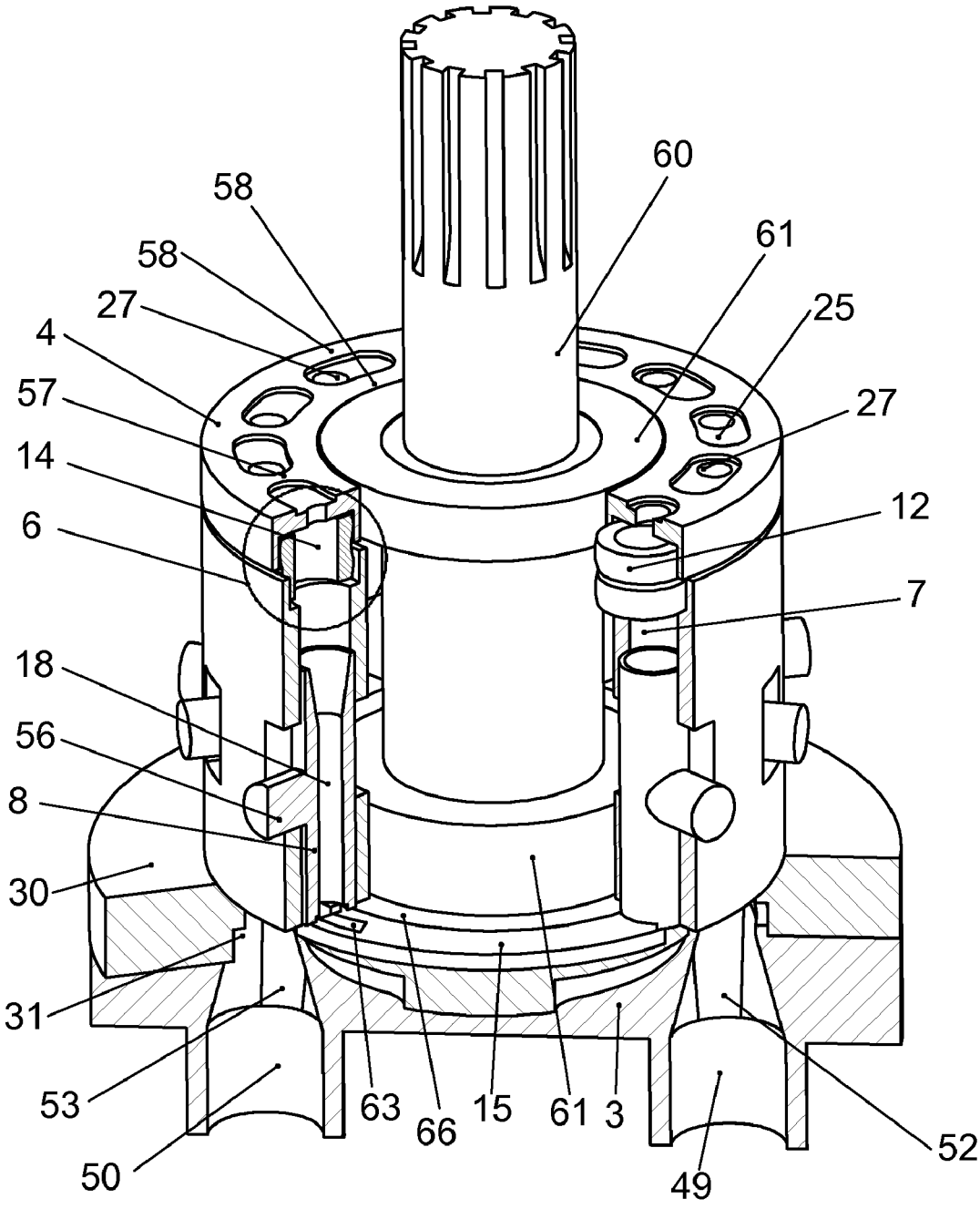
Figure 2A:
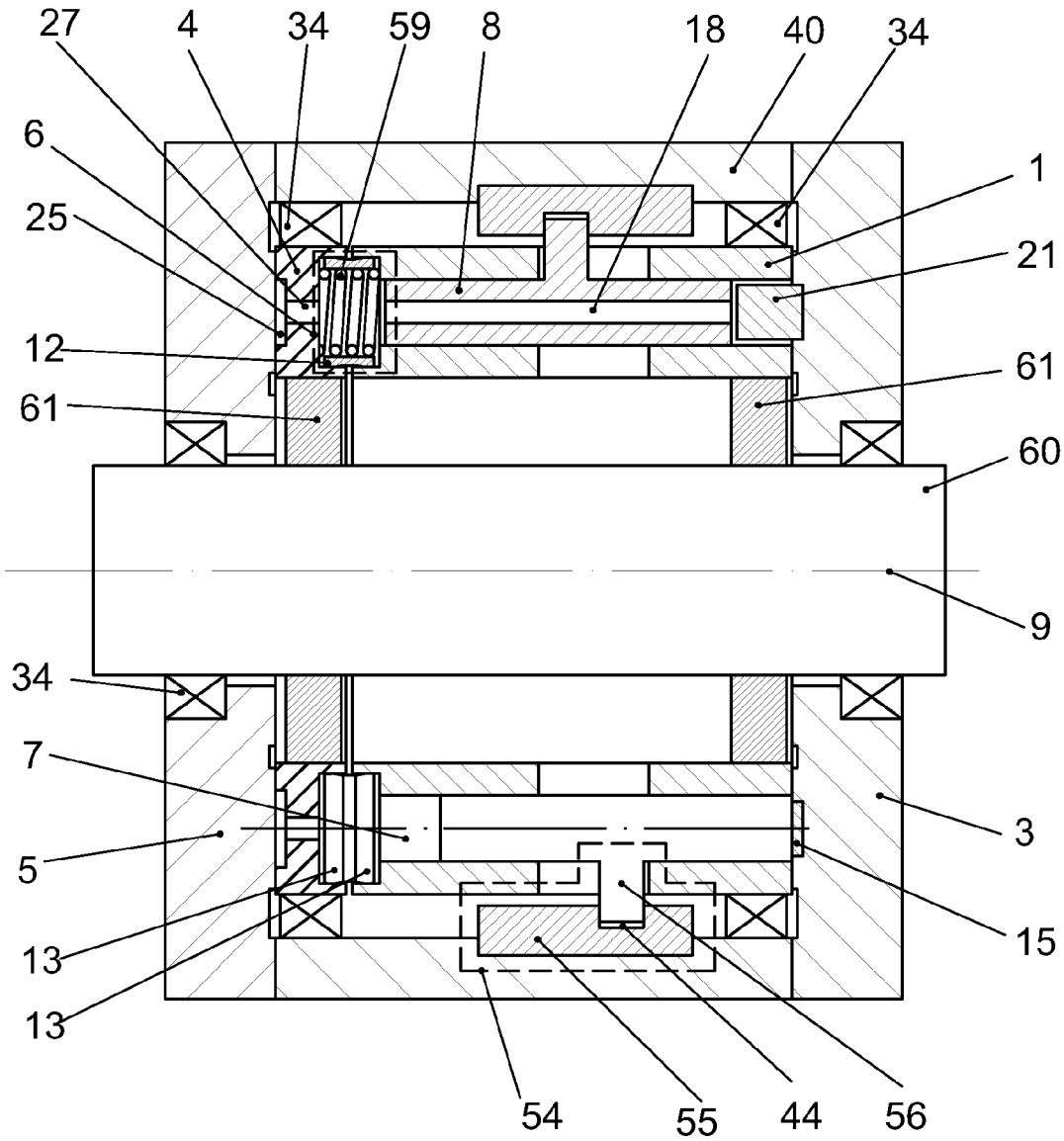
Figure 2B:
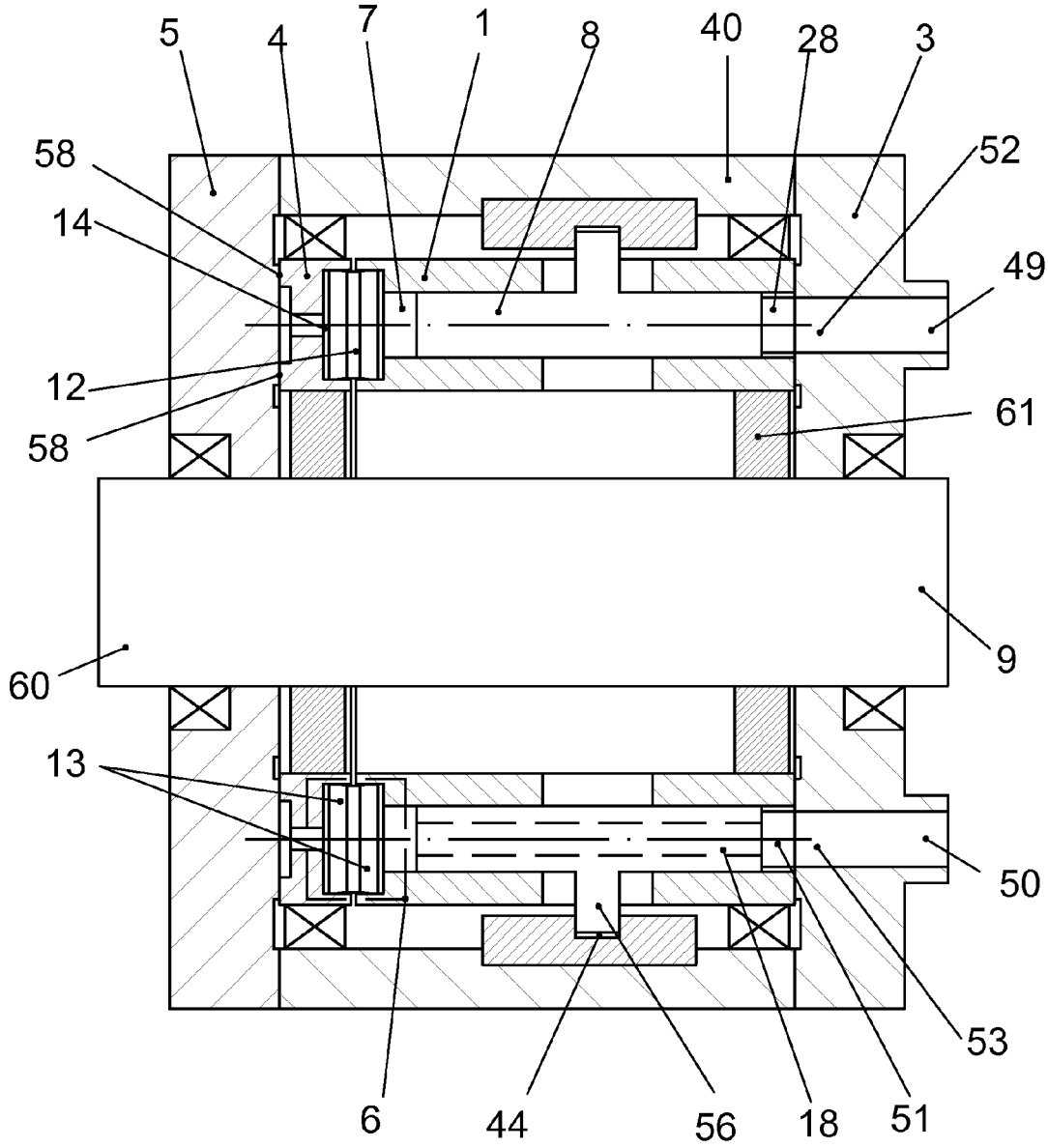
Figure 2C:
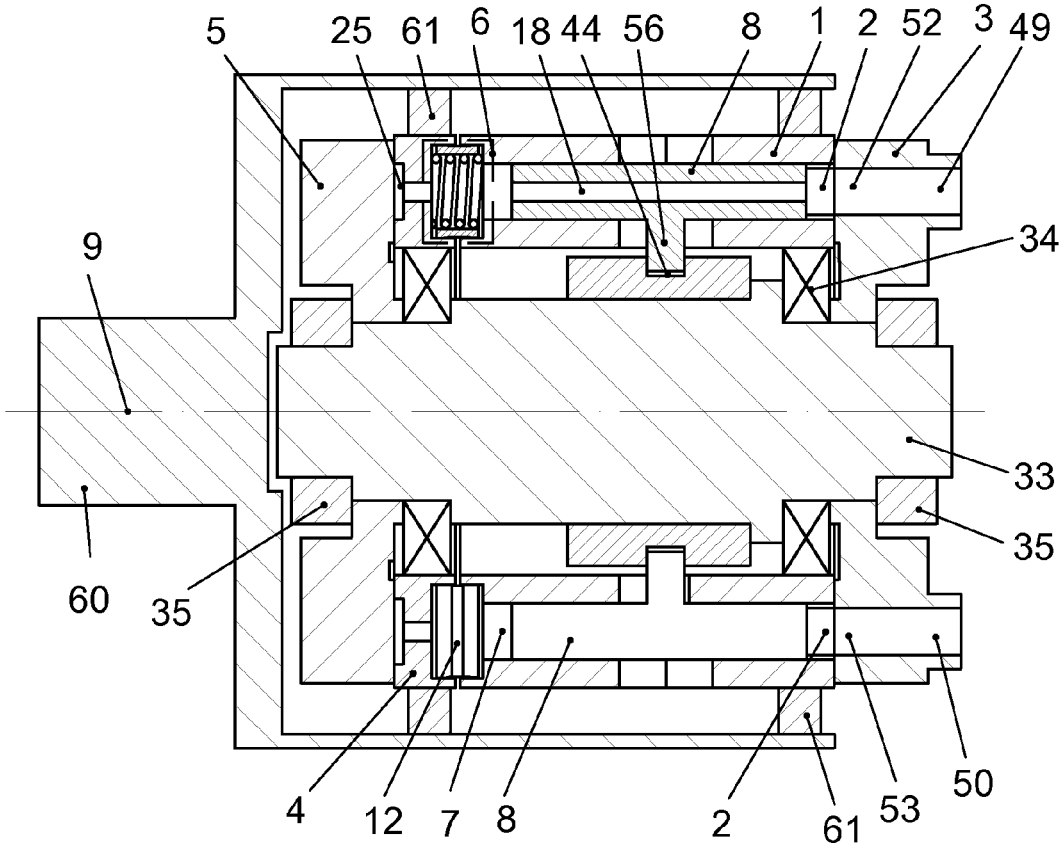
Figure 2D:
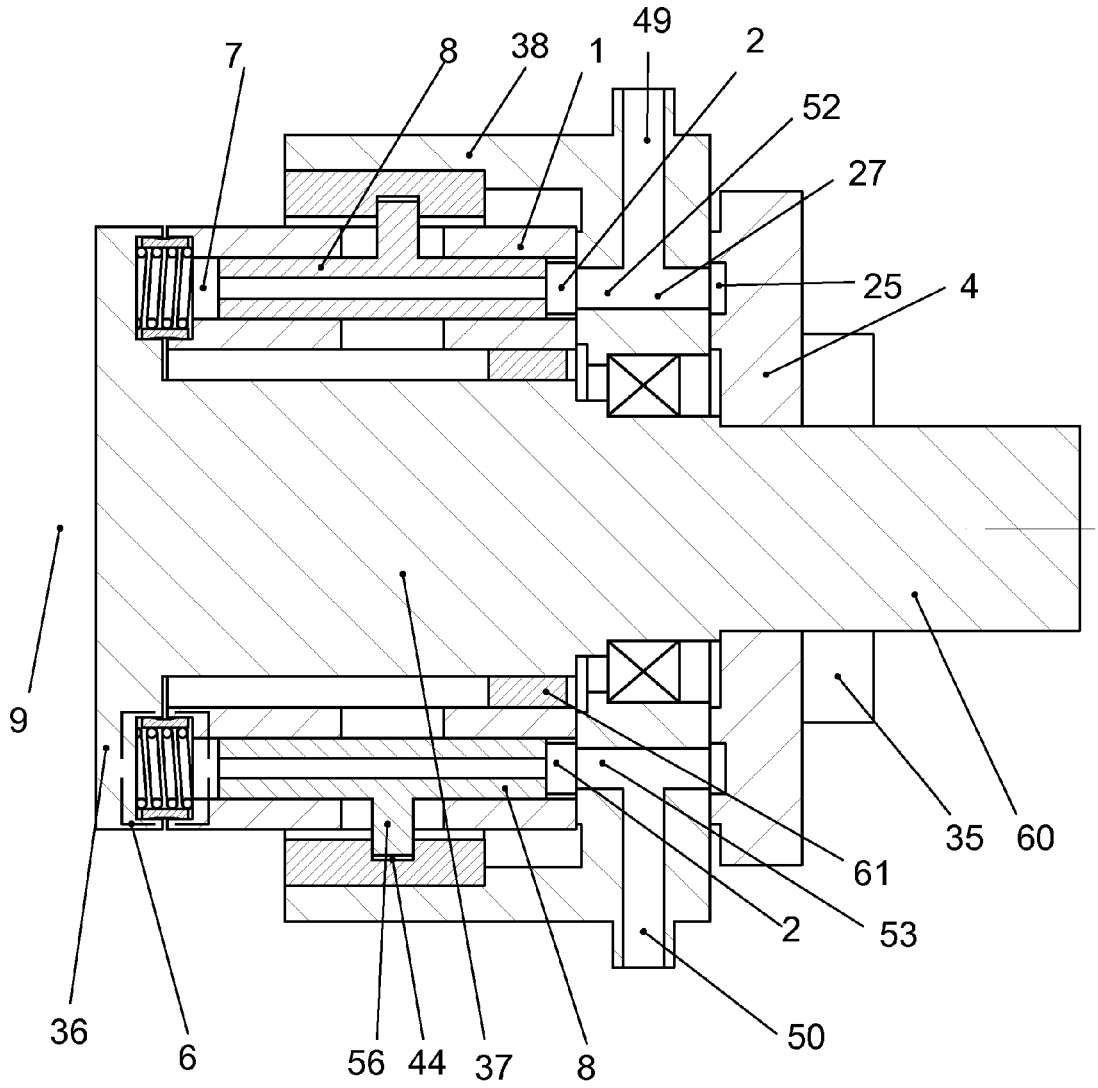
Figure 2E:
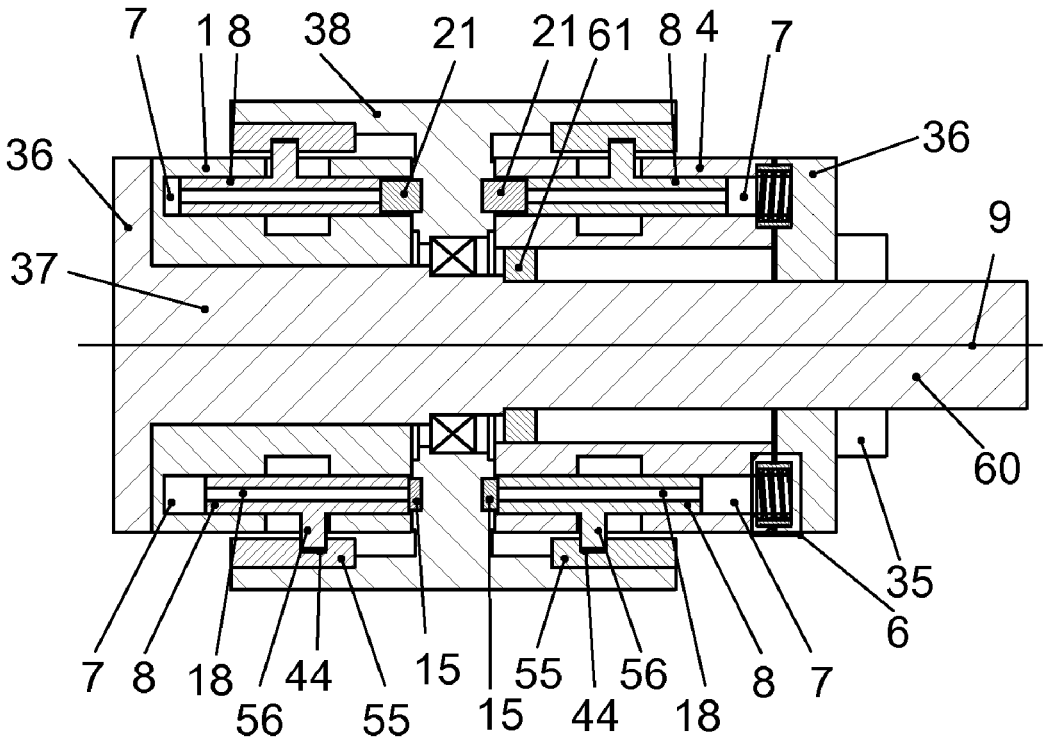
Figure 2F:
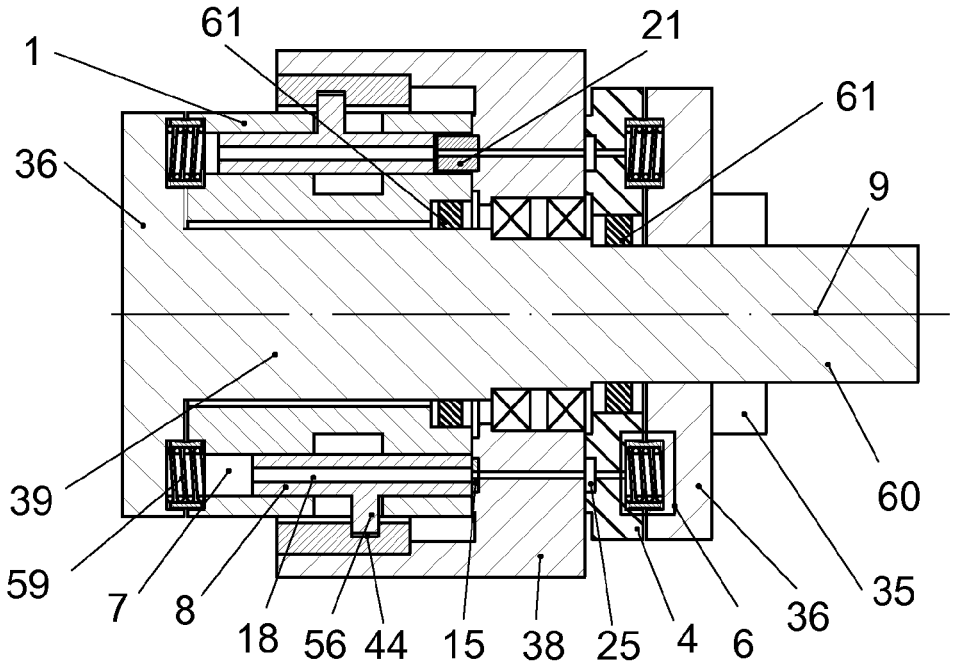
Figure 2F:
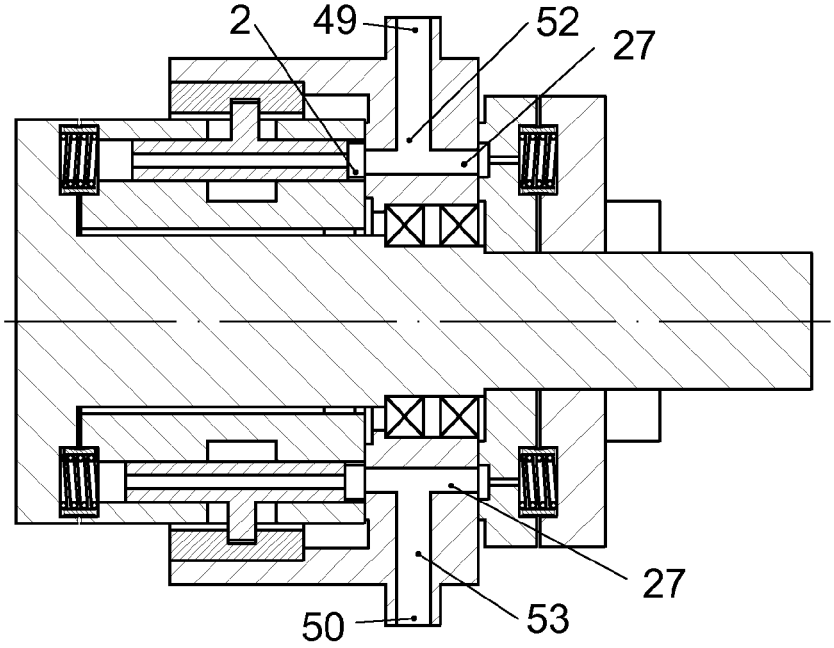
Figure 2G:
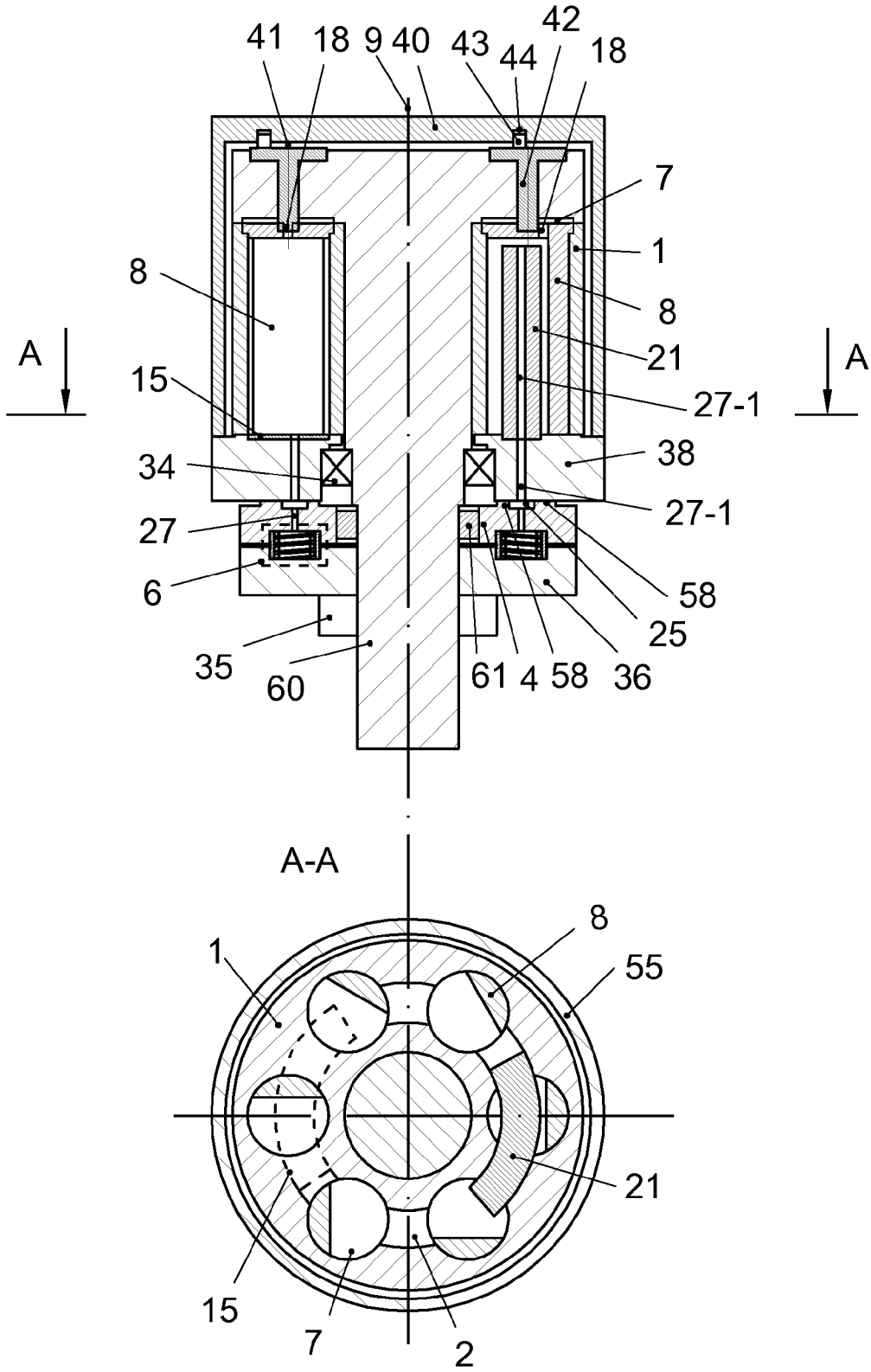
Figure 2H:
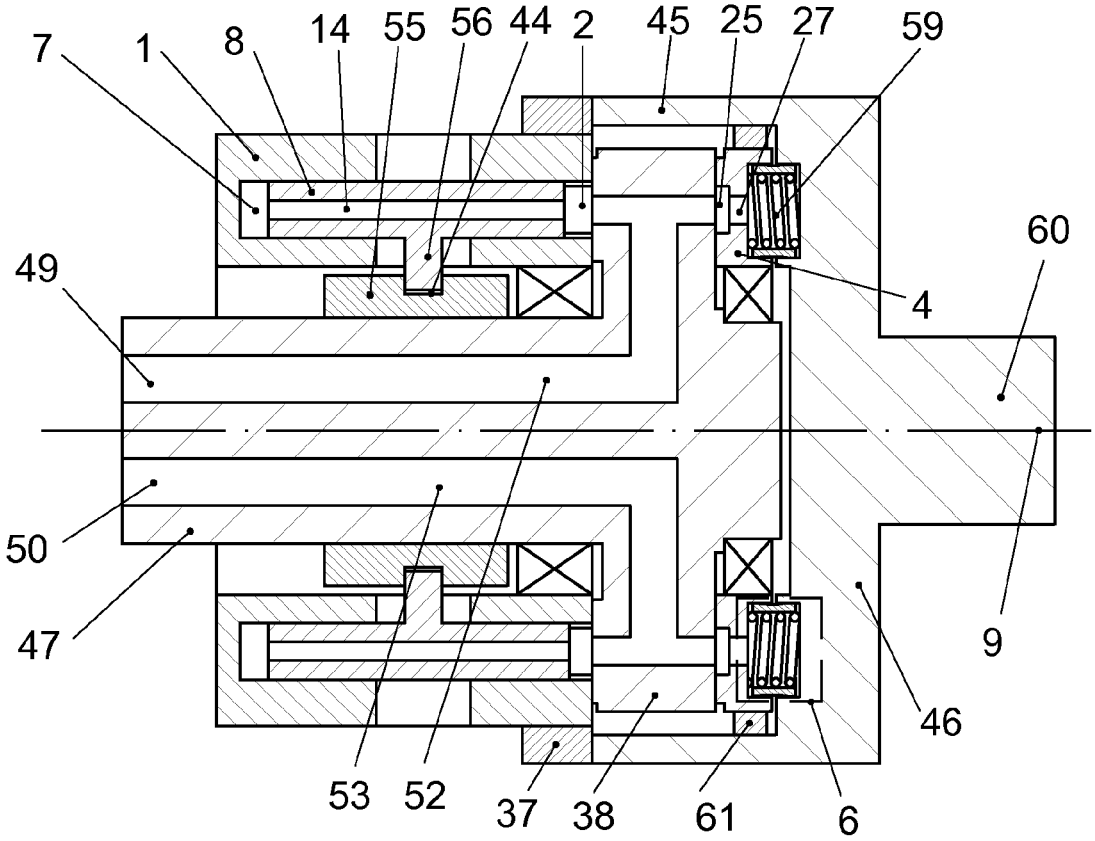
Figure 2I:
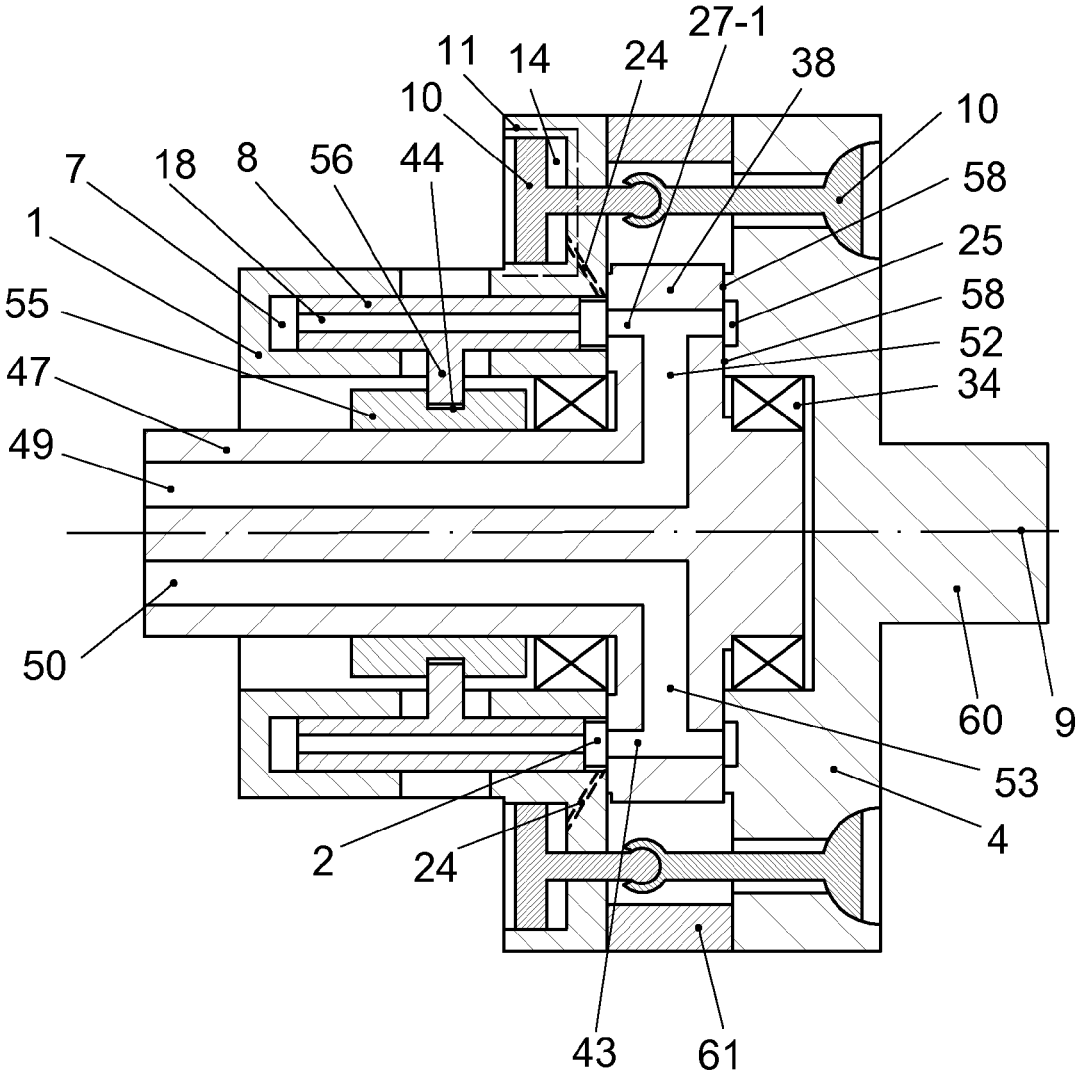
Figure 2J:
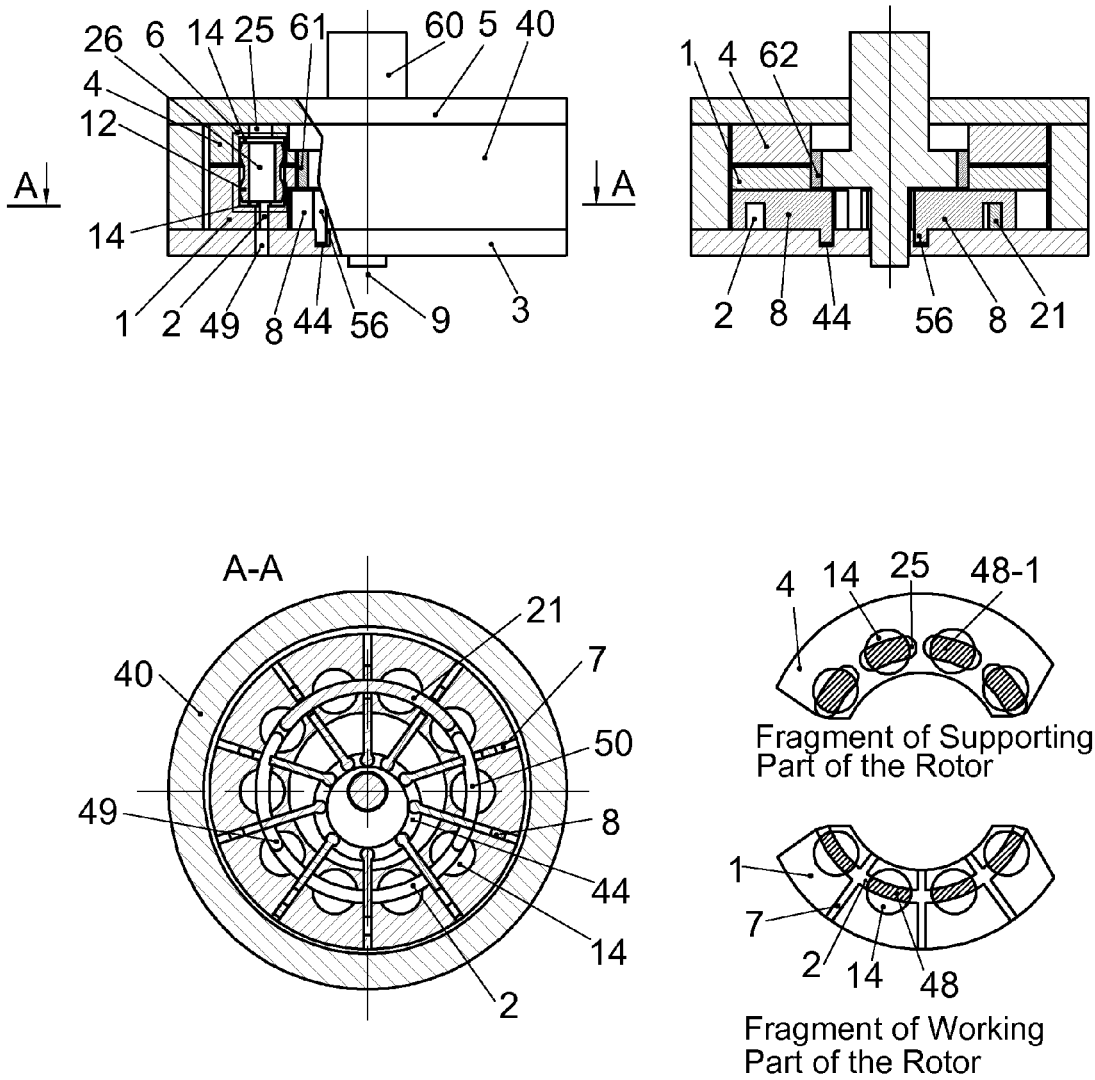
Figure 3A:
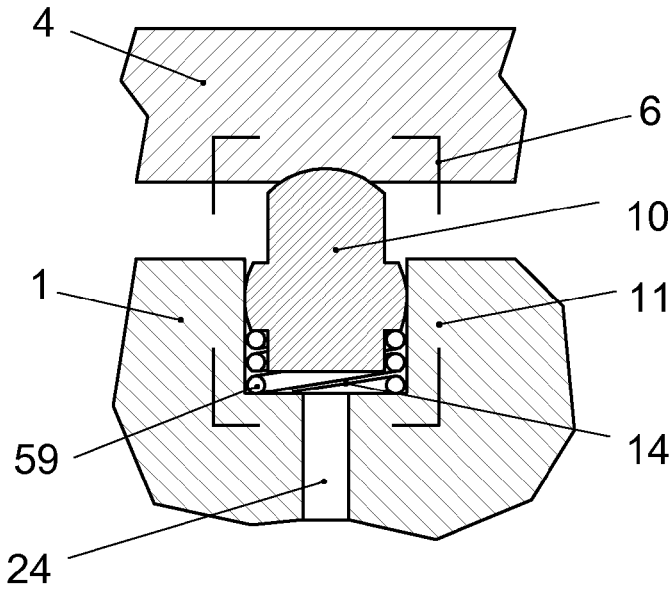
Figure 3B:
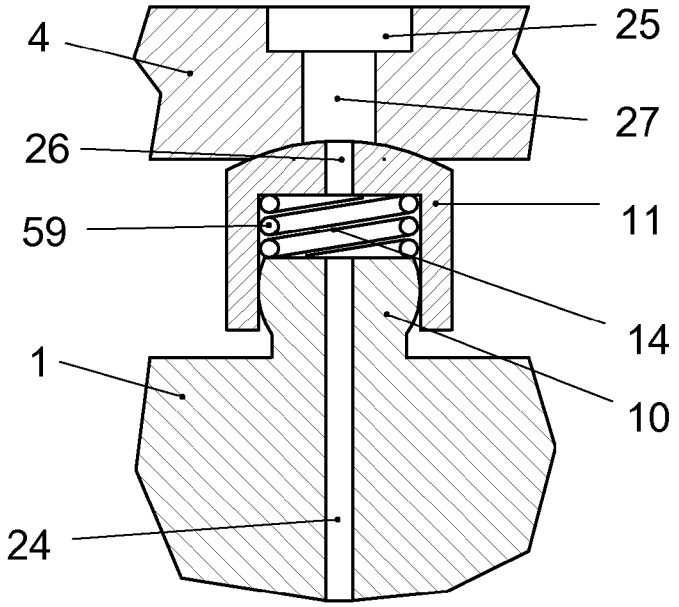
Figure 3C:
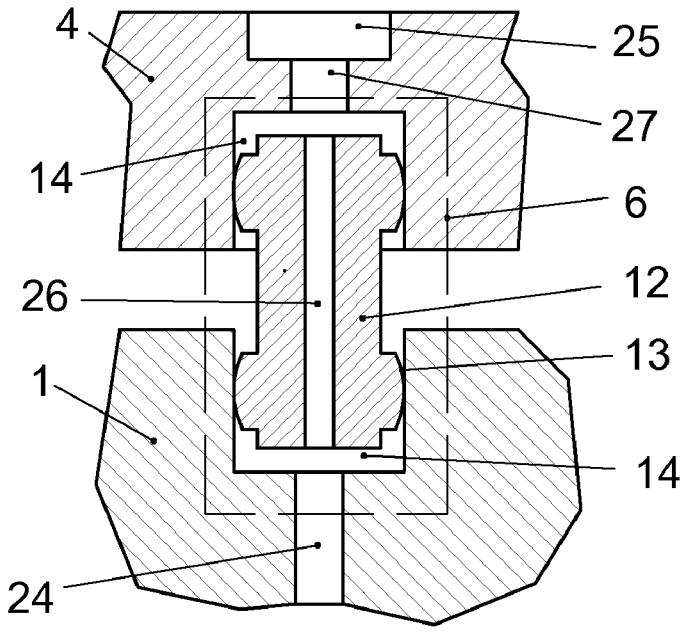
Figure 3D:
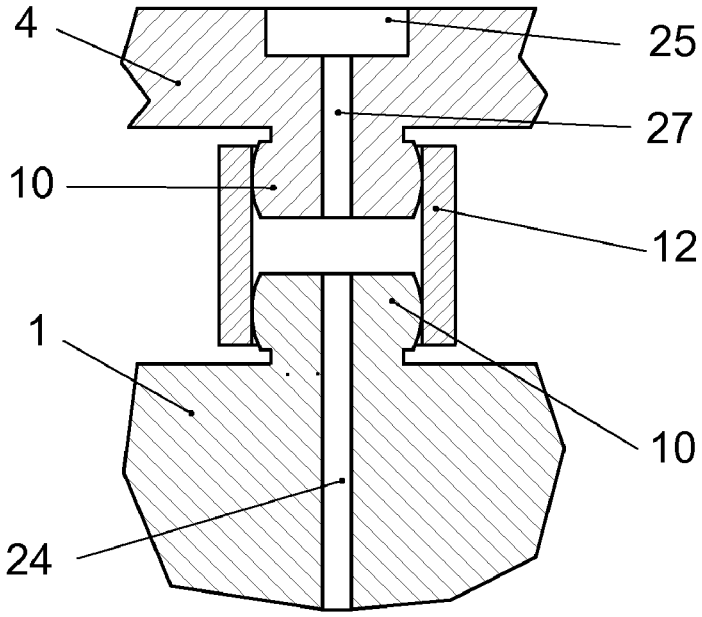
Figure 3E:
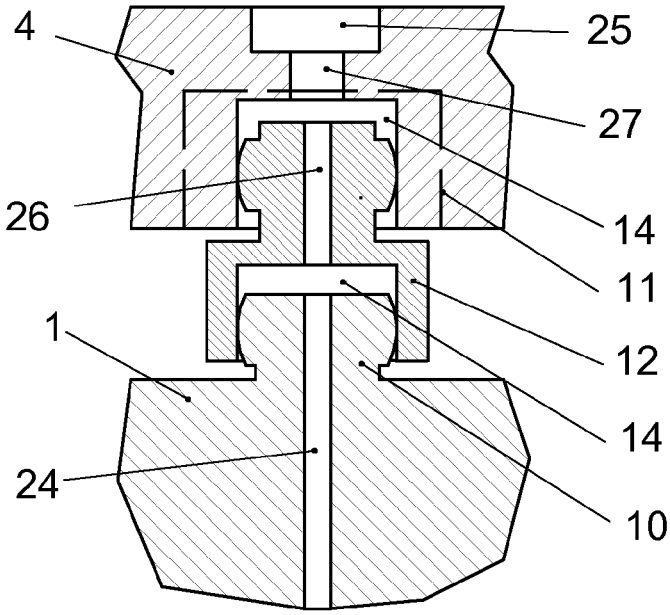
Figure 3F:
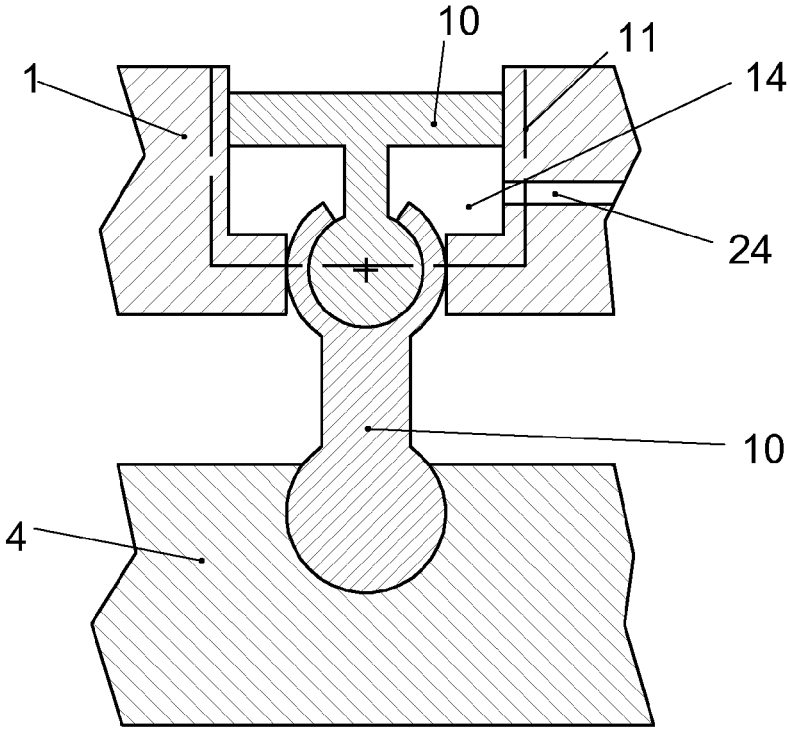
Figure 3G:
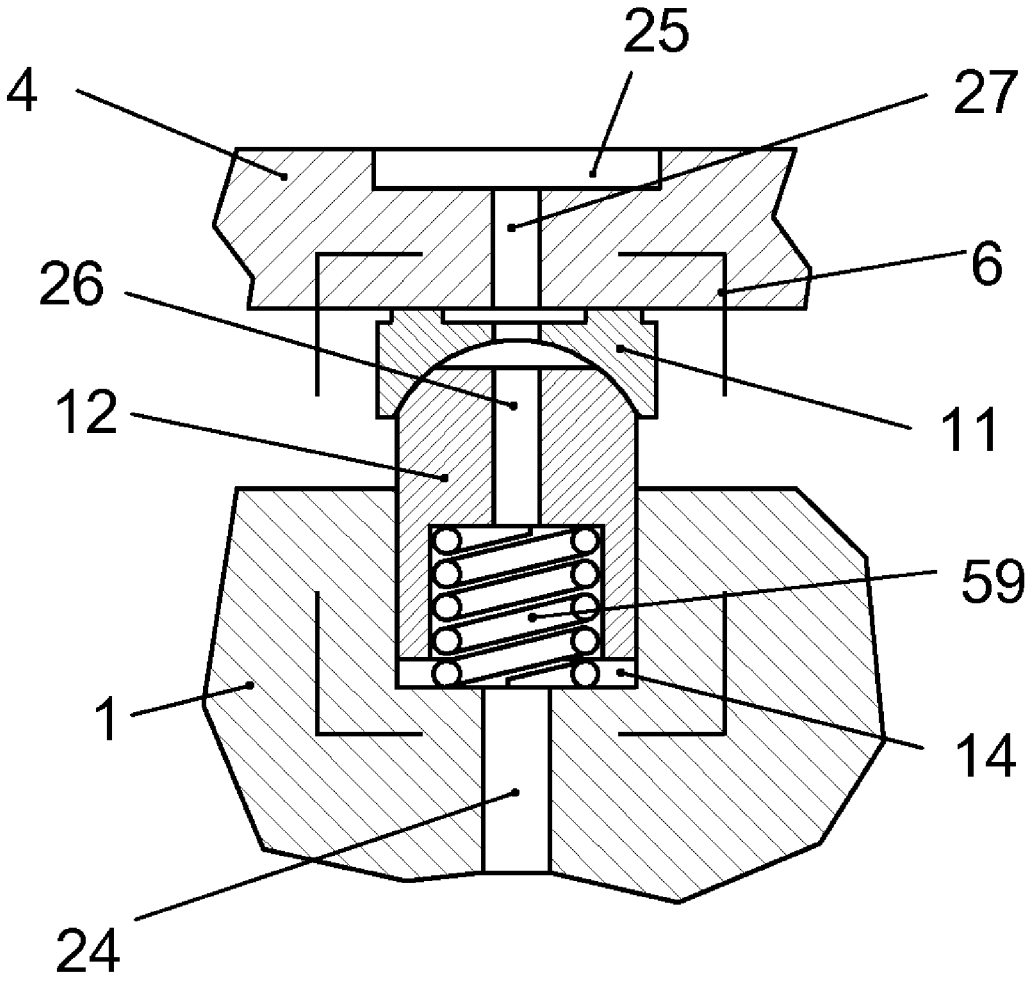
Figure 4A:
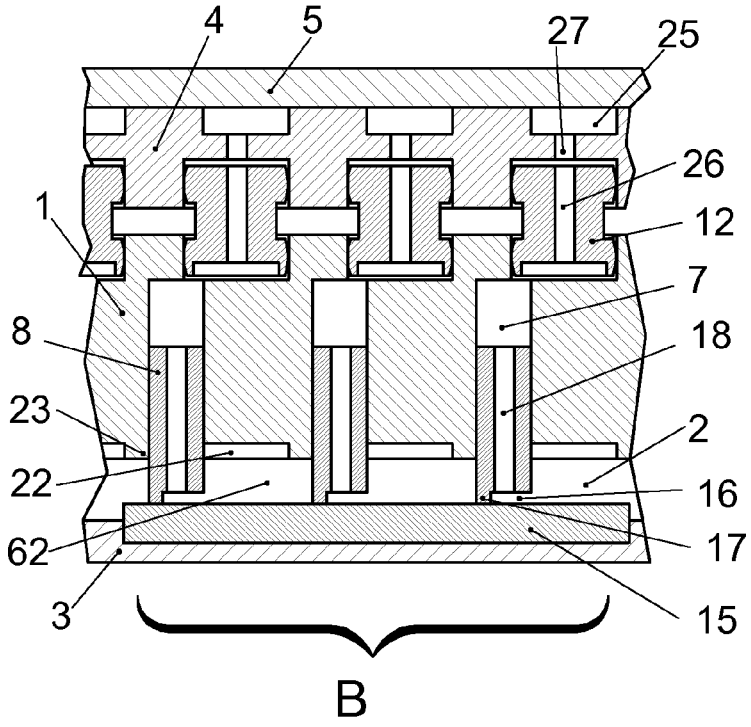
Figure 4B:
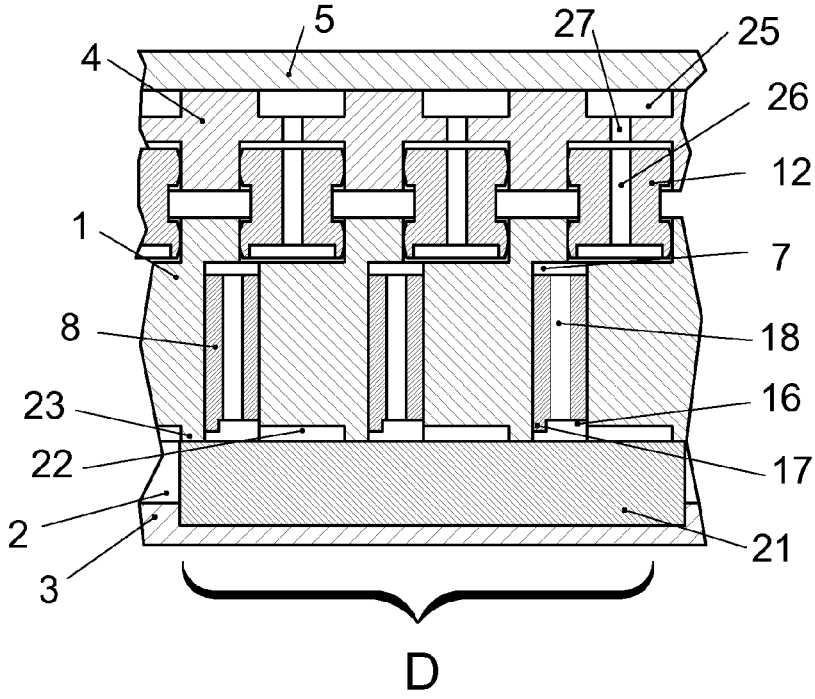
Figure 5A:
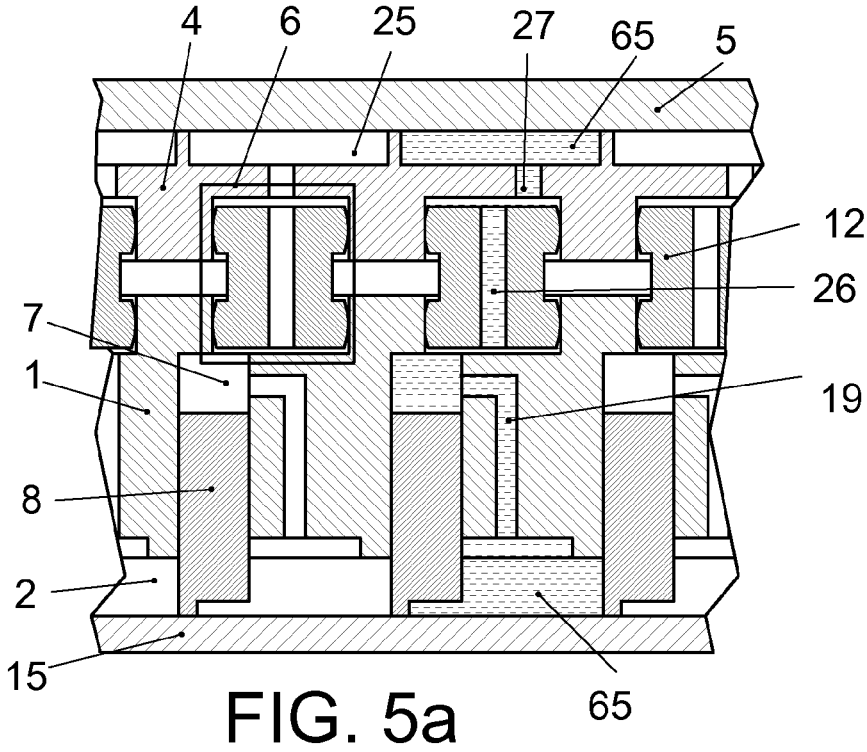
Figure 5B:
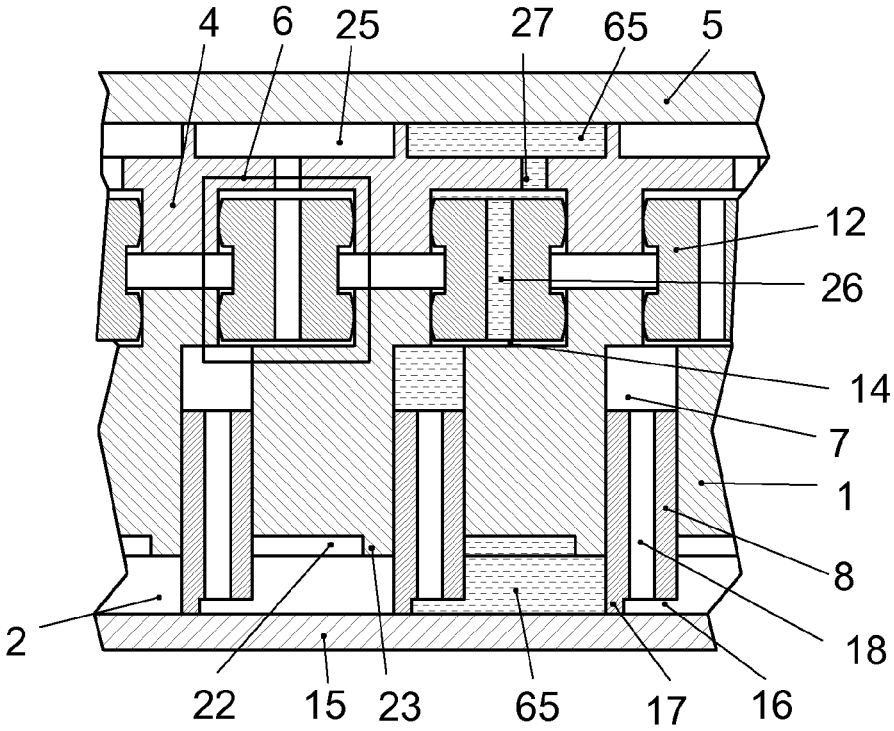
Figure 5C:
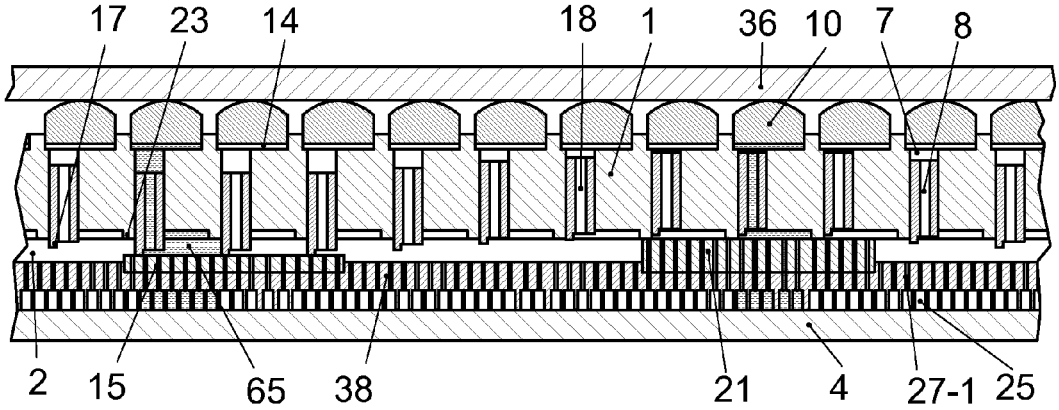
Figure 5D:
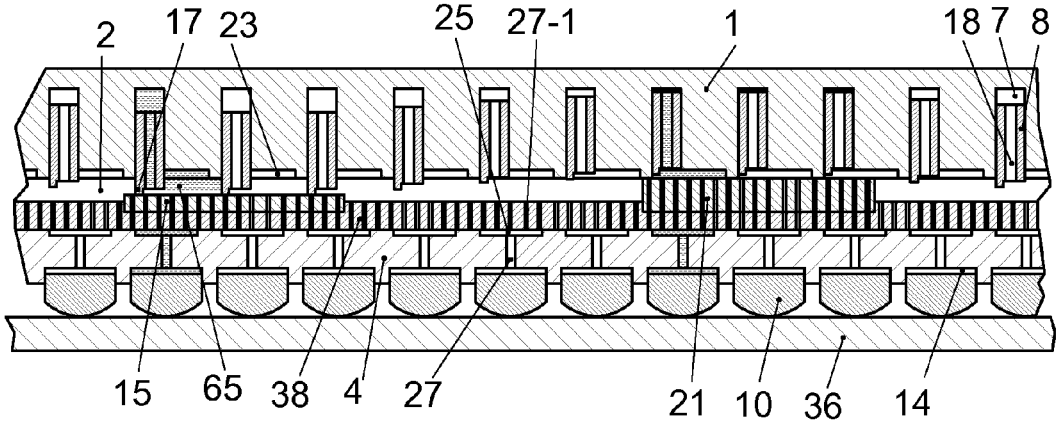
Figure 5E:
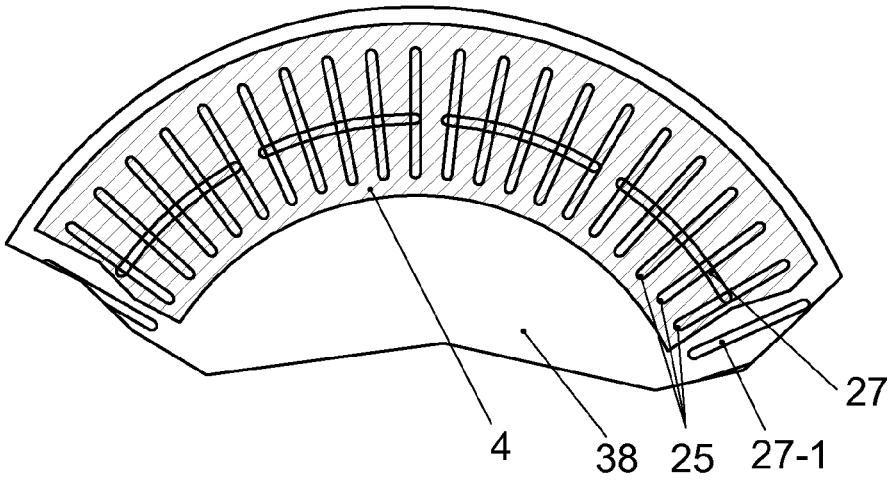
Figure 5F:
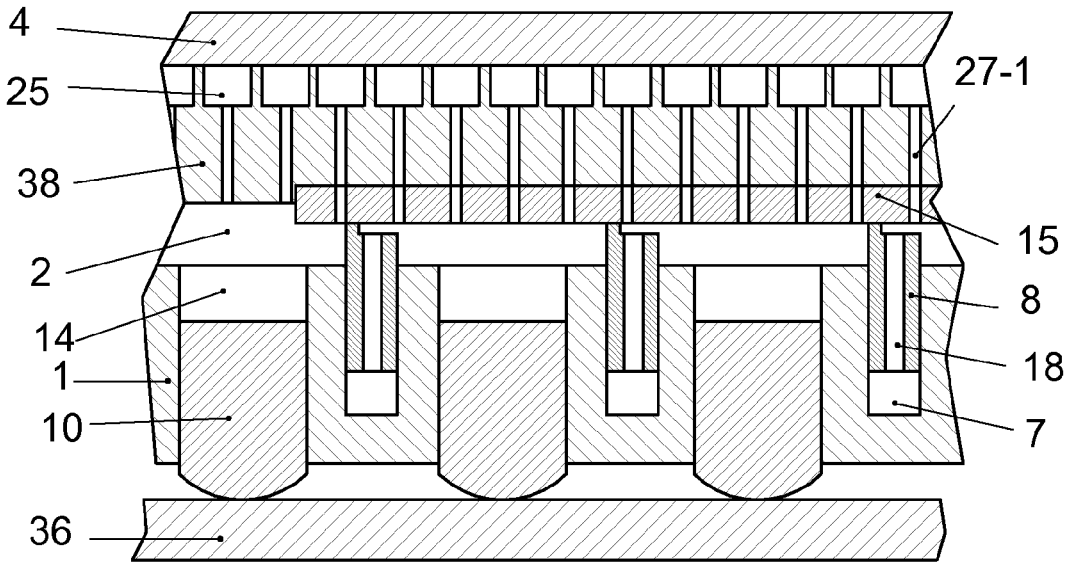
Figure 6:
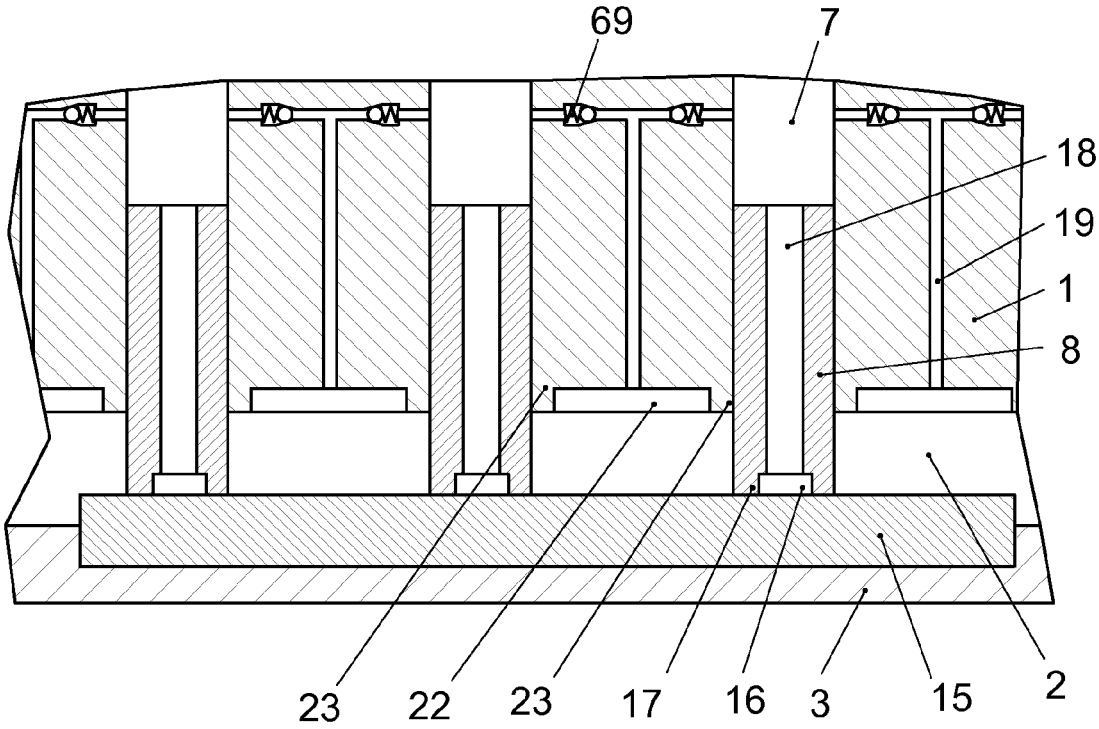
Figure 7:
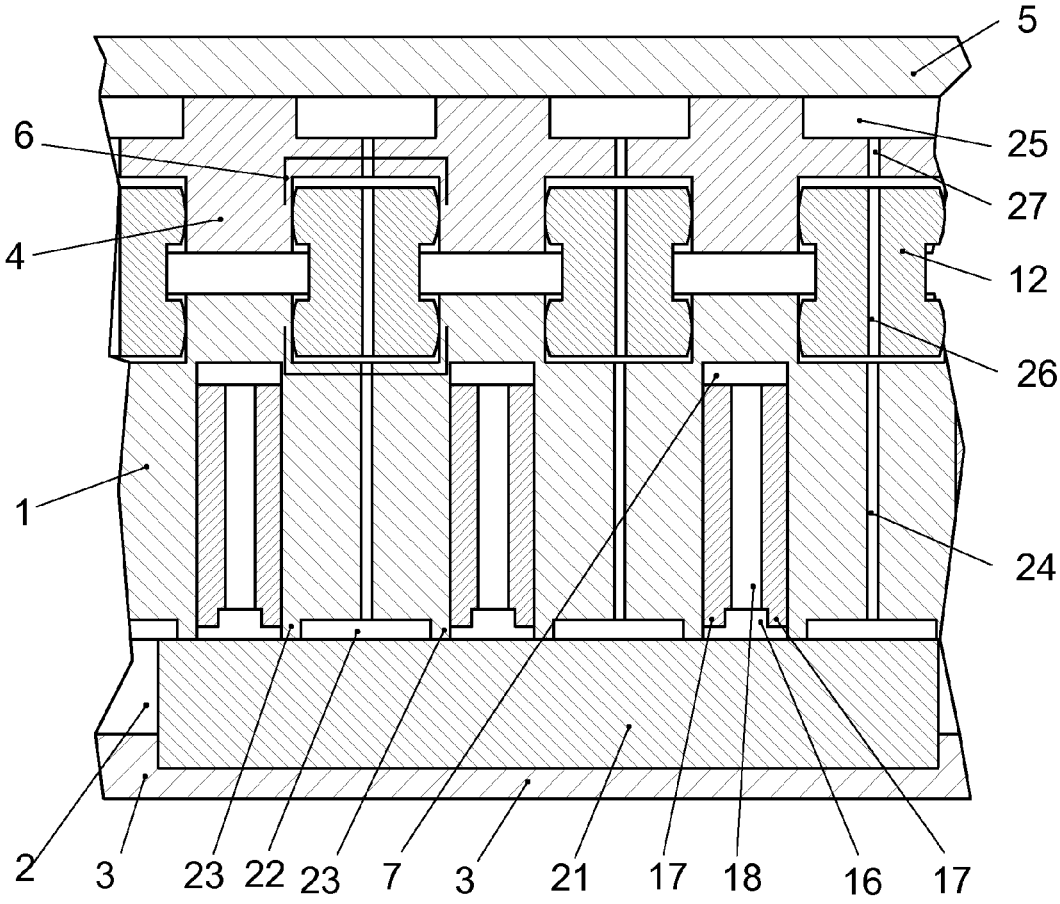
Figure 8A:
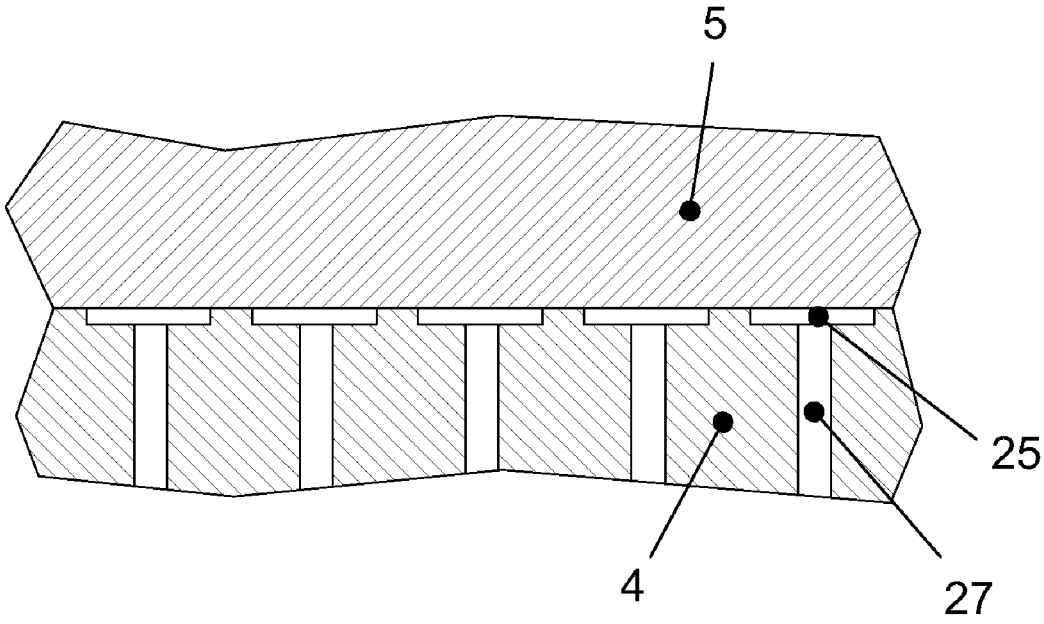
Figure 8B:
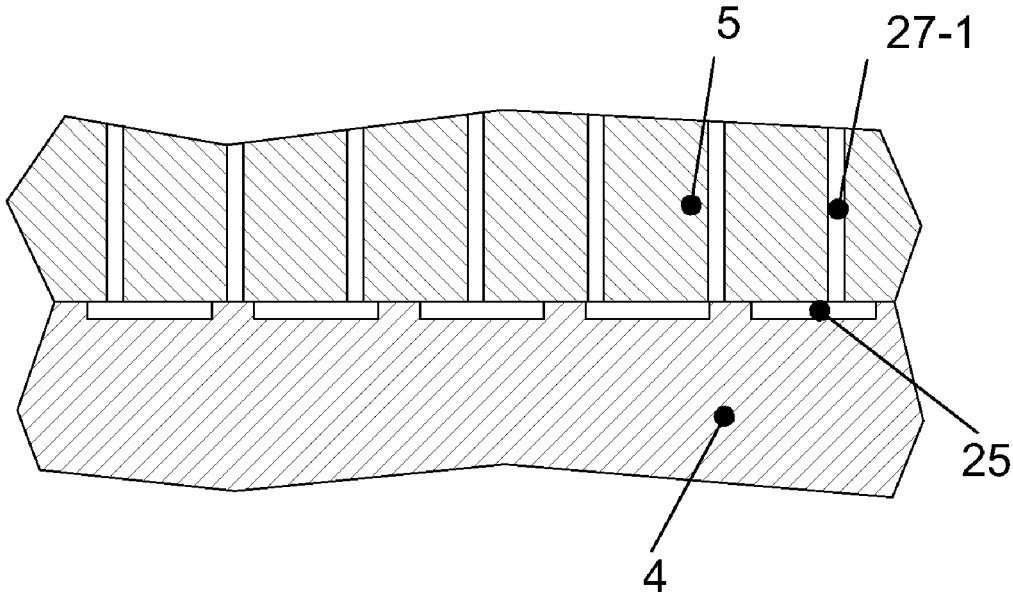
Figure 9:
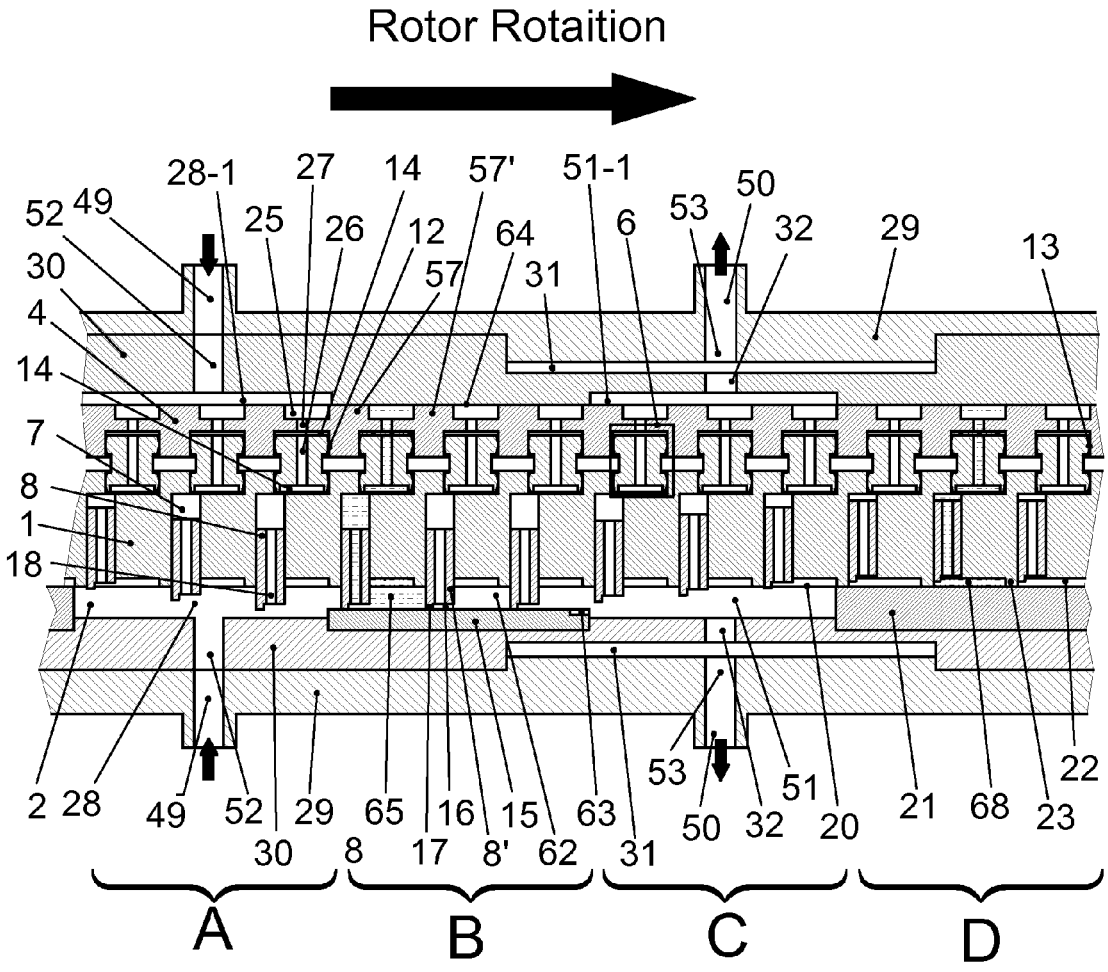
Figure 10:
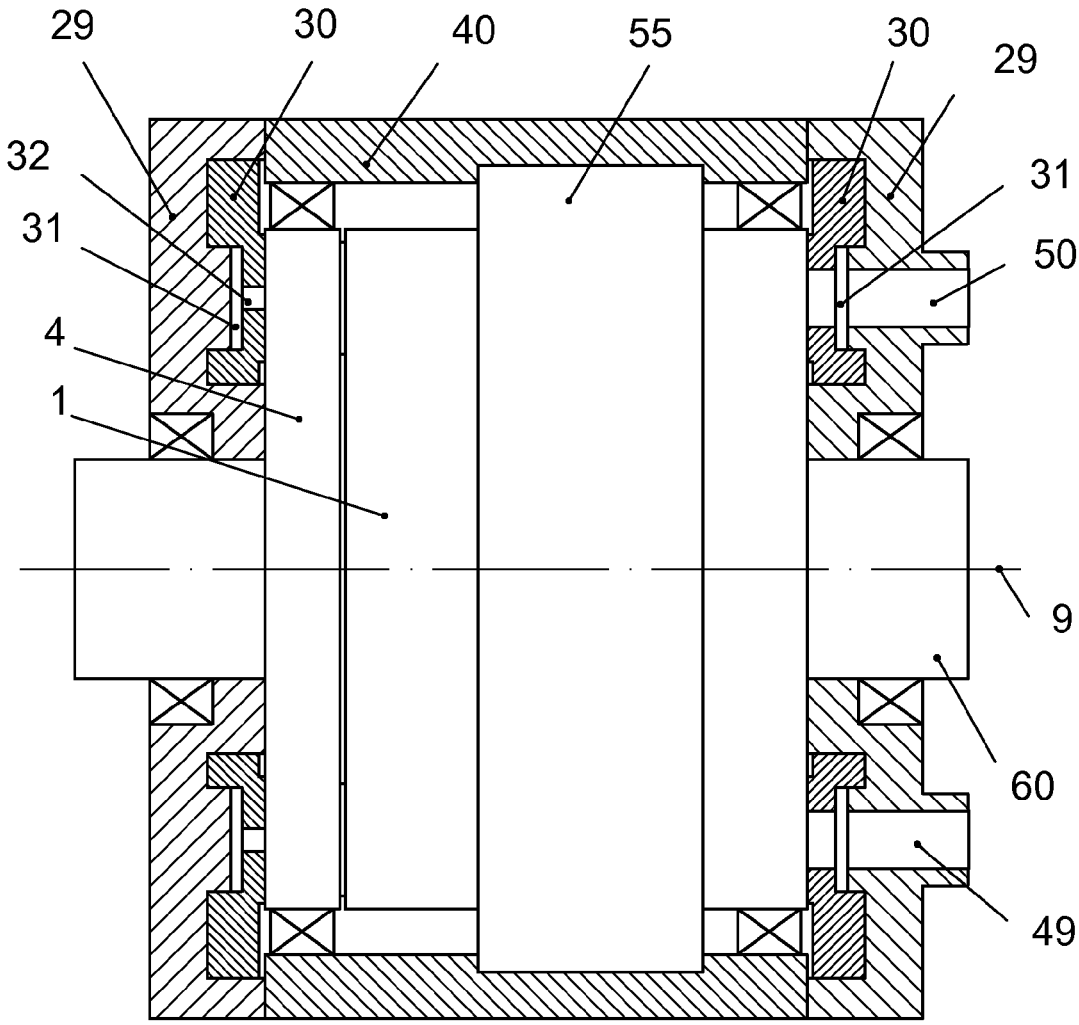

The essence of the present invention is explained by the drawings representing the following:

FIG. 1*a*—rotor sliding-vane machine with an adaptive rotor and force closure to the housing—cut-out quarter of the rotor—view from the side of the working part of the rotor, working cover plate of the housing, vanes drive mechanism and housing linking element are not shown;

FIG. 1*b*—rotor sliding-vane machine with an adaptive rotor and force closure to the housing—cut-out quarter of the rotor—view from the side of the supporting part of the rotor, the supporting cover plate of the housing, vanes drive mechanism and housing linking element are not shown;

FIG. 2*a*—rotor sliding-vane machine with an adaptive rotor and force closure to the housing with the cover plates linked by a linking element located outside the rotor (housing in the form of a hollow cylinder)—axial section with the plane passing through the forward and backward transfer limiters;

FIG. 2*b*—rotor sliding-vane machine with an adaptive rotor and force closure to the housing with the cover plates linked by a linking element located outside the rotor (housing in the form of a hollow cylinder)—axial section with the plane passing through the input and output ports;

FIG. 2*c*—rotor sliding-vane machine with an adaptive rotor and force closure to the housing with the cover plates linked by a linking element located inside the rotor (housing in the form of a "bobbin")—axial section with the plane passing through the input and output ports;

FIG. 2*d*—rotor sliding-vane machine with an adaptive rotor, force closure to the rotor and supporting part of the rotor coupled with the rotor linking element made in a form of a "bobbin"—axial section with the plane passing through the input and output ports;

FIG. 2*e*—rotor sliding-vane machine with an adaptive rotor, force closure to the rotor and the working part of the rotor coupled with the rotor linking element made in the form of a "bobbin", with two working chambers in both parts of the rotor and two sets of vanes—axial section with the plane passing through the forward and backward transfer limiters;

FIG. 2*f*—rotor sliding-vane machine with an adaptive rotor, force closure to the rotor and a rotor linking element made in the form of a "bobbin"—axial sections: with the plane passing through the forward and backward transfer limiters (view 1) and with the plane passing through the input and output ports (view 2);

FIG. 2*g*—rotor sliding-vane machine with an adaptive rotor, force closure to the rotor, pivoted character of the vanes movement and the working part of the rotor coupled with the rotor linking element made in the form of a "bobbin"—axial section with the plane passing through the forward and backward transfer limiters and section with the plane perpendicular to the axis of the rotor rotation and passing through the annular groove;

FIG. 2*h*—rotor sliding-vane machine with an adaptive rotor, force closure to the rotor and the working part of the rotor coupled with the rotor linking element made in the form of a hollow cylinder—axial section with the plane passing through the input and output ports;

FIG. 2*i*—rotor sliding-vane machine with an adaptive rotor, force closure to the rotor without rotor linking element and with working and supporting parts of the rotor connected by the force chambers of variable length working to attract the parts of the rotor to each other—axial section with the plane passing through the input and output ports;

FIG. 2*j*—rotor sliding-vane machine with an adaptive rotor and force closure to the housing, radial character of the vanes movement and force chambers of variable length connected directly to the annular groove and directly to the supporting cavities;

FIG. 3*a*—embodiment of the force chamber of variable length: one force cavity and one embedded element in the form of a piston with a spherical face;

FIG. 3*b*—embodiment of the force chamber of variable length: one force ledge and one containing element in the form of a cylinder with spherical face and through channel supported by the supporting part of the rotor comprising supporting cavity and through channel;

FIG. 3*c*—embodiment of the force chamber of variable length: two force cavities and one cannular connector;

FIG. 3*d*—embodiment of the force chamber of variable length: two force ledges and one cannular connector;

FIG. 3*e*—embodiment of the force chamber of variable length: containing element in the supporting part of the rotor, force ledge in the working part of the rotor and a connector comprising containing element and embedded element;

FIG. 3*f*—embodiment of the force chamber of variable length working to attract the parts of the rotor to each other;

FIG. 3*g*—embodiment of the force chamber of variable length: one containing element is made in the working part of the rotor, the second containing element comprising the supporting cavity and through channel flatly slides along the supporting part of the rotor, a connector in the form of cylinder with spherical face and a through channel, is supported by the second containing element;

FIG. 4*a*—forward transfer area—fragment of circular development of the annular groove;

FIG. 4*b*—backward transfer area—fragment of circular development of the annular groove;

FIG. 5*a*—embodiment of the means of local pressures balancing: annular groove—channel in the working part of the rotor—vane chamber—channel in the force chamber—channel in the supporting part of the rotor—supporting cavity;

FIG. 5*b*—embodiment of the means of local pressures balancing: annular groove—channel in the vane—vane chamber—channel in the force chamber—channel in the supporting part of the rotor—supporting cavity;

FIG. 5*c*—embodiment of the means of local pressures balancing: force chamber—vane chamber—channel in the vane—annular groove—channel in the operational unit of the housing—supporting cavity in the operational unit of the housing;

FIG. 5*d*—embodiment of the means of local pressures balancing: vane chamber—channel in the vane—annular groove—channel in the operational unit of the housing—supporting cavity in the supporting part of the rotor—channel in the supporting part of the rotor—force chamber of variable length;

FIG. 5*e*—fragment of the means of local pressures balancing: supporting cavities in the form of a radial slots in the housing connected to the channels in the form of longitudinal arc slots in the supporting part of the rotor;

FIG. 5*f*—embodiment of the means of local pressures balancing: force chamber of variable length—annular groove—channel in the operational unit of the housing—supporting cavity in the operational unit of the housing;

FIG. 6—embodiment of hydro-tightening of the vanes: vane chamber connected to both adjacent inter-vane cavities via the channels with valves;

FIG. 7—embodiment of the bottom unloading cavities and bottom sealing ledges: bottom cavity separated by two bottom ledges from both adjacent vane chambers and connected via the channel to the force chamber of variable length—fragment of circular development of the annular groove;

FIG. 8*a*—embodiment of the supporting cavities: supporting cavities in the rotor are connected to the channels in the rotor—fragment of circular development of the annular groove;

FIG. 8*b*—embodiment of the supporting cavities: supporting cavities in the rotor are connected to the channels in the housing—fragment of circular development of the annular groove;

FIG. 9—rotor sliding-vane machine with an adaptive rotor and force closure to the housing—transferred volume in the suction, forward transfer, pumping and backward transfer areas—circular development of the annular groove;

FIG. 10—cover plates of the housing comprising anti-deformation chambers made between the functional elements and load-bearing elements of the cover plates;

DETAILED DESCRIPTION OF THE INVENTION

The basic idea of the present invention provides for numerous embodiments of a rotor sliding-vane machine suitable for use as a pump or as a hydro motor both reversible and with fixed direction of the rotor rotation, and also as a pumping-motor unit of hydromechanical transmission. In some embodiments of the invention the housing is fixed to the rack of the aggregate and the rotor rotates relative the housing and the rack of the aggregate. In other embodiments of the invention the rotor can be fixed to the rack of the aggregate and the housing rotates relative it. It is also possible to have an embodiment with the rotor and the housing rotating relative to the rack of the aggregate, for example, if the rotor machine is a unit of a hydromechanical transmission. Hereafter we shall consider relative rotation of the rotor and housing irrespective of the type of installation of the rotor machine in the aggregate. In any case the rotor will mean a unit having an annular groove in the face element and having the vanes making cyclical movements relative the rotor at every turn of the rotor, changing the degree of their sliding into the annular groove. The housing is a unit relative to which the location of inlet and outlet ports does not change at reciprocal rotation of the rotor and the housing.

Hereinafter the preferred embodiments of all essential elements of the rotor machine are described. There is also a detailed description of the structure and the operation of the preferred embodiment of machine working as a multi-purpose pump.

An adaptive rotor depicted in FIGS. 1*a*, 1*b* is divided into two parts, working part 1 with face annular groove 2 made in it's working face forming the working chamber and being in sliding contact with insulating surfaces of working cover plate 3 of the housing FIGS. 2*a*, 2*b*, and supporting part 4 with the supporting face being in sliding contact with the insulating surfaces of supporting cover plate 5 of the housing. These two parts of the rotor are connected to each other by an assemblage of rotor elements so that they can rotate synchronously but having a possibility to make small axial movements and tilts relative each other in order to keep sliding insulating contact with both cover plates of the housing at rotor rotation. The mentioned assemblage of rotor elements includes known from the prior art means of the rotation synchronization made, for example, in the form of a joint of equal angular velocities and also includes rotor force chambers of variable length 6 FIGS. 3*a*, 3*b*, 3*c*, 3*d*, 3*e*, 3*f*, made so that the pressure forces acting upon working part of the rotor 1 from the side of the working chamber in annular groove 2 and from the side of force chambers 6 change synchronously in transfer areas. For this purpose the number of such force chambers 6 shall be equal or divisible by the number of vane chambers 7 and each force chamber of variable length 6 is hydraulically connected to annular groove 2 of working part of the rotor 1, so that each cavity being formed during the rotation of the rotor in annular groove 2 of working part of the rotor 1 in forward transfer area between two adjacent vanes 8 and characterized by its individual character of local pressure changing is hydraulically connected to its force chamber of variable length 6 so that local pressures in the mentioned cavity and in the force chamber 6 connected to it are substantially equal. In the preferred embodiment of the invention each force chamber of variable length is connected to the nearest cavity in the annular groove.

Force chambers of variable length are made so that the change of their length leads to the mentioned reciprocal movements of the working and supporting parts of the rotor required for insulation. According to the essence of the invention pressure forces of the working fluid in the mentioned force chambers applied to the working and supporting parts of the rotor do not depend at given pressure on the change of the force chamber length.

The said force chambers of variable length can be made differently, for example, using bellows or elastic side walls. The preferred embodiment of the invention has a force chamber of variable length formed by containing elements and embedded elements mounted with a possibility of reciprocal movement, with outer walls of the embedded elements being in sliding insulating contact with the inner walls of the containing elements so that they seal the force chamber at the mentioned reciprocal movements of the working and supporting part of the rotor required for insulation.

Embedded and containing elements can be made as elements separate from the parts of the rotor but kinematically connected to them. The preferred embodiments of the invention provide for that the mentioned containing or embedded elements are made directly on the parts of the rotor. The first embodiment has a containing element that can be made as force cavity 14 FIG. 3*a*, like a cylinder, in the working or supporting part of the rotor, and if the rotor contains a linking element as, for example, described below for the machines with force closure to the rotor, the mentioned force cavities can be made in the linking element of the rotor. The second embodiment has embedded element 10 FIG. 3*b* that can be made as a force ledge, like a piston, on the working or supporting part of the rotor and on the linking element of the rotor as well.

If the amplitudes of the mentioned reciprocal movements of the working and supporting parts of the rotor are little the force chamber can be made by one pair of containing and embedded element, for example, as a hydro cylinder FIGS. 3*a*, 3*b*.

If there are expected big amplitudes of the mentioned reciprocal movements of the parts of the rotor, especially reciprocal tilts, the present invention provides for an embodiment of the force chamber of variable length as two pairs of containing and embedded elements, for example, when force chamber of variable length is formed by two containing elements 11 FIG. 3*c* mounted with a possibility of reciprocal movements and by one embedded element in the form of connector 12 with external walls being in sliding insulating contact with the internal walls of both containing elements.

In FIG. 3*g* one containing element is made as a cylindrical cavity in working part of the rotor 1, and second containing element 11 with internal spherical insulating surface and external flat insulating surface is mounted so that its flat surface is in sliding contact with the flat surface of supporting part of the rotor 4. Embedded element in the form of connector 12 has external cylindrical and spherical insulating surfaces being in sliding insulating contact with internal cylindrical and spherical surfaces of the containing elements correspondingly.

In other embodiments the force chamber is formed by two embedded elements 10 FIG. 3*d* mounted with a possibility of reciprocal movement and by one containing element in the form of connector 12 with internal walls being in sliding insulating contact with external walls of both embedded elements, or force chamber is formed by first containing element 11 FIG. 3*e* and the first embedded element mounted with a possibility of reciprocal movement and by the second containing element combined with the first embedded element into one connector 12 with external walls being in sliding insulating contact with internal walls of the first containing element and internal walls being in sliding insulating contact with external walls of the second embedded element.

The mentioned sealing of the sliding contact at axial movements and tilts can be made in accordance with the nowadays state of arts, for example, using spherical sealing shoulders 13 FIGS. 3*a*, 3*b*, 3*c*, 3*d*, 3*e* on external surface of the embedded elements.

The preferred embodiment of the invention provides for force chambers of variable length made so that reciprocal movement of the mentioned containing and embedded elements of the force chamber when its length is changed is directed significantly parallel to the axis of the rotor rotation. There is provided such an embodiment of the mentioned force chambers that pressure forces of the working fluid contained in the force chamber tend to increase total length between the ends of its elements, for example, by displacing the embedded element from the containing element or by pushing apart the pair of the elements connected by sliding contact to the connector and to move the working and supporting parts of the rotor closer to the corresponding cover plates of the housing. For the embodiments of the machine with force closure to the rotor described below the invention also provides for such an embodiment of force chambers of variable length that pressure forces of the working fluid contained in the force chamber tend to decrease total length between the ends of its elements, for example, by pushing embedded element 10 into containing element 11 FIG. 3*f*, and so moving the working and supporting parts of the rotor closer to each other and to the corresponding cover plates of the housing combined into the operational unit of the housing located between the working and supporting parts of the rotor.

If required force chambers can be made so that the mentioned reciprocal movement of the elements forming these chambers is directed significantly unparallel to the axis of rotor rotation. In this case it is assumed that the mentioned assemblage of rotor elements providing kinematical connection of the working and supporting parts of the rotor includes the means of transforming the forces direction in order to transfer the movements of the force chamber elements to the working and supporting parts of the rotor. The mentioned means of transforming the forces direction can include leverage, cam or other elements known from the prior art used for similar purposes.

FIGS. 1*a*, 1*b*, 3*c* present force chambers 6 connected to vane chambers 7 and including force cavities 14 in the supporting and working parts of the rotor and cannular connectors 12 with sealing shoulders 13 mounted with their ends in the mentioned force cavities so that to seal force chambers at reciprocal axial movements and tilts of the working and supporting parts of the rotor.

According to the invention force chambers of variable length have elastic elements, for example, springs, to provide sealing pressing of the parts of the rotor to the cover plates of the housing at zero or low pumping pressure.

Generally, inter-vane cavities of the working chamber formed in transfer area in annular groove 2 can be unconnected to the cavities formed in transfer area in vane chambers 7 and inside vanes 8. In this case the pressure in these cavities shall change differently and for complete balancing it will be required to juxtapose each of that cavities with the corresponding force chamber of variable length 6. Their number will be divisible by the number of vane chambers. But to provide self-sealing of the face surfaces of vanes 8 sliding along forward transfer limiter 15 FIG. 4*a* it is convenient to connect the cavity located in vane chamber 7 from the side of the vane's face opposite the sealing face to that cavity in annular groove 2 between the mentioned vane and the adjacent vane from which the mentioned vane displaces the fluid to the pumping cavity. In case of a hydromotor the fluid, on the contrary, displaces the vane. Therefore, in general case to provide hydrostatical tightening of vane 8 to the surface of forward transfer limiter 15 the mentioned cavity in vane chamber 7 should be connected to that of two cavities in the annular groove between the said vane and the adjacent vanes that has higher pressure. In this case the opposite face of the vane shall be acted upon with greater force than the sealing face and vane 8 shall be pressed to forward transfer limiter 15 with a force proportional to the pressure difference between the inlet and the outlet. In order to prevent excessive losses on friction between the surface of vane 8 and forward transfer limiter 15, the mentioned surface of the vane shall have vane unloading cavity 16 hydraulically connected to the cavity in the vane chamber adjacent to the opposite surface of the vane and vane sealing ledge 17. Form and area of vane unloading cavity and vane sealing ledge should be determined by means of optimization of proportion between the leakages rate in the clearance of sliding insulating contact of vane's surface with the transfer limiter and amount of friction losses of the face of the vane on the forward transfer limiter.

One of the preferred embodiments of the invention provides for axially movable vane 8 containing through channel 18 connecting the mentioned cavity in the vane chamber to vane unloading cavity 16 on the surface of the vane sliding on the forward transfer limiter, and vane sealing ledge 17 made so that the mentioned vane unloading cavity 16 is connected to the inter-vane cavity described above. Another embodiment of the invention provides for channels 19 FIG. 5*a* made in the working part of the rotor connecting the mentioned cavities in the vane chambers to the corresponding inter-vane cavities in annular groove 2.

In case of such connection of the cavities the number of the insulated transferred volumes is equal to the number of vane chambers of the working part of the rotor. Accordingly, the number of force chambers can be the same.

If the machine is made convertible, i.e. intended for use as a pump or as a motor and if the machine is made reversible, i.e. capable of changing the direction of working fluid flow without changing the direction of the rotor rotation, location of the higher pressure cavities relative to the chosen vane chamber in forward transfer area changes when the working mode is changed. In this case to provide the described hydro tightening of the vanes the channels of the mentioned hydraulic connection of vane chambers to the annular groove are provided with valve elements 69 so that the vane chamber is connected to that cavity in the annular groove between the said and the adjacent vanes where the pressure is higher FIG. 6. In such an embodiment it is reasonable to make some force chambers of variable length connected via the channels to the cavities in the annular groove between the vanes directly, and the other force chambers of variable length connected to the vane chambers. In case of such a connection the number of force chambers of variable length should be reasonably chosen equal to doubled number of the vane chambers of the working part of the rotor. In this case vane sealing ledges 17 sliding on forward transfer limiter 15 separate vane unloading cavities 16 from both adjacent inter-vane cavities in annular groove 2. There is also provided such an embodiment of through channels in a vane that vane unloading cavities are bound by the walls of the mentioned channels.

The pressure in the mentioned force chambers of variable length is always equal to the pressure in the corresponding cavities in the annular groove. To balance pressure forces of the fluid acting upon the working part of the rotor from the side of the working cover plate of the housing with pressure forces of the fluid from the side of the force chambers, size, form and location of the force chambers shall be chosen on the basis of configuration of pressure forces distribution between the working part of the rotor and working cover plate of the housing. The mentioned pressure forces are formed both by the fluid located in the cavities of the working chamber and fluid flowing between adjacent cavities of the working chambers with different pressures and the fluid flowing out of the cavities of the working chamber through clearances of face seals.

The invention provides for two embodiments of rotor means of backward transfer insulation.

In the first embodiment in backward transfer area as well as in forward transfer area the insulation is provided by sliding contact of spots of the face surfaces of the vanes with the surface of the corresponding transfer limiter. In this case configuration of the cavities and corresponding seals between the working part of the rotor and working cover plate of the housing determining geometrical distribution of pressure forces of the working fluid repelling the working part of the rotor from the working cover plate of the housing are similar in both transfer areas and allow for easy determining of the required characteristics of the force chambers. But it should be taken into consideration that in this case the location of the nearest inter-vane cavity with a higher pressure relative to the chosen vane chamber shall differ for forward transfer area and backward transfer area as described above for forward transfer area of reversible or convertible machines. Therefore embodiment of hydraulic connection of the vane chambers with the annular groove for hydro tightening of the vanes and embodiment of force chambers shall be similar to that described above for such machines.

In the second embodiment of design the insulation in the working chamber in forward transfer area B FIG. 4*a* is provided by sliding contact of vane 8 with the surface of forward transfer limiter 15 and the insulation in the working chamber in backward transfer area D FIG. 4*b* is provided by sliding contact of a spot of the bottom of the annular groove in the face of the rotor with the surface of backward transfer limiter 21. In this case configuration of the cavities in the annular groove connected to the corresponding force chambers and of the corresponding seals generally is not identical for forward and backward transfer areas. As a result pressure forces of the fluid acting upon the working part of the rotor from the side of the working cover plate of the housing may differ in value at the same pressure in the transferred volumes in forward and backward transfer areas. Besides, the centers of these forces application to the working part of the rotor are shifted if put on the same fragment of the rotor. The shift value of the center of the fluid pressure forces application to the working part of the rotor depends on the dimensions and location of the sealing surfaces of the vane face and the spot of the annular groove bottom relative to each other.

In order to the force chamber of constant configuration could provide balancing of the effects on the working part of the rotor from the side of the working chamber in both areas there is offered a method of minimizing the change of geometrical characteristics of the cavities in the annular groove by minimizing the areas of the sealing spot on the surface of the bottom of the groove in the rotor and maximum approaching of these parts to the sealing spots of the face surfaces of the vanes. For this purpose the surface of the annular groove bottom between the vanes has bottom unloading cavities 22 and sealing ledges 23 FIG. 4*b*. The mentioned bottom sealing ledges are in sliding insulating contact with the backward transfer limiter and divide adjacent transferred volumes in backward transfer area D.

For reversible or convertible machines the preferred embodiment of the invention FIG. 7 provides for such an embodiment of bottom unloading cavities and sealing ledges where every spot of the annular groove bottom between two adjacent vane chambers 7 has at least two sealing ledges 23 and one unloading cavity 22 between them so that in backward transfer area the mentioned bottom unloading cavity is separated by sliding insulating contact of two mentioned bottom sealing ledges with backward transfer limiter 21 from both nearest vane chambers 7. In this case the means of local pressures balancing include channels 24 in the working part of the rotor via which every bottom unloading cavity 22 is connected to its force chamber of variable length 6, nearest with regard to closest angular distance. There is also provided such an embodiment of the mentioned channels 24 where their cross dimensions are close or even equal to the dimensions of the bottom unloading cavities. In the latter case the mentioned bottom unloading cavities are bounded by the walls of the mentioned channels.

For the machines with the fixed location of high pressure cavities relative to the inlet and outlet port it is provided that every spot of the annular groove bottom between two neighboring vane chambers has one unloading cavity and one sealing ledge adjacent to the first of the two mentioned vane chambers with a vane separating the mentioned bottom unloading cavity in forward transfer area from high pressure cavity and the unloading cavity is connected to the second mentioned vane chamber. FIG. 7 presents vane sealing ledge 17 and neighboring bottom sealing ledge 23 located as close to each other as possible, i.e. on the adjacent spots of the corresponding surfaces.

In case of the described embodiments of bottom unloading cavities and sealing ledges choosing the dimensions of force chambers allows for axial balancing of the working part of the rotor in both transfer areas. Shift of the centers of pressure force application to the working part of the rotor from the side of the working cover plate of the housing will lead to the appearance of variable moments of forces tending to turn the working part of the rotor around the axis perpendicular to the axis of the rotor rotation. Therefore the force chambers are located with a shift so that the moments of the forces arising in forward and backward transfer areas compensate each other.

To provide sealing between face surfaces of the working part of the rotor and the corresponding surfaces of the working cover plate of the housing it is reasonable to choose the form and dimensions of the force chambers inside the rotor so that to provide a small pressing of the working part of the rotor to the sealing elements of the working cover plate of the housing. To provide the required pressing the sum of cross-sectional areas of all force chambers of variable length shall exceed the area of the projection of the annular groove to the plane perpendicular to the axis of rotation of the working part of the rotor for a value depending on the area and character of abutment of the surfaces of sliding insulating contact of the working part of the rotor with the working cover plate of the housing.

For example, in case of flat clearances between the surfaces of the mentioned sliding insulating contact to calculate the balance of pressure forces it is required to add at least 50% of the area of the mentioned sliding insulating contact to the mentioned area of projection of the annular groove. In case of non-flat insulating surfaces and clearances between them the corresponding coefficient by which the area of the sliding insulating contact of the working part of the rotor with the working cover plate of the housing is multiplied while summing up with the area of the mentioned projection of the annular groove can be determined empirically.

Minimum required value of the mentioned area excess is determined taking into account the elasticity of elastic elements of force chambers of variable length and friction forces that have to be overcome to provide the required reciprocal movements of the working and the supporting parts of the rotor. The mentioned friction forces include friction forces in sliding insulating contacts between the embedded and containing elements of the force chambers and rotor elements transmitting the torque, for example, joints of equal angular velocities.

Balancing the Supporting Part of the Rotor: Supporting Cavities and Means of Local Pressures Balancing.

Supporting part 4 FIG. 1*b* of the rotor is exposed to the symmetrical forces from the side of force chambers of variable axial length 6 towards the corresponding surface of supporting cover plate 5 of the housing. Thus, the working and supporting parts of the rotor move apart to abut against the corresponding sealing surfaces of the housing.

Each of the force chambers of variable axial length 6, including those located opposite forward 15 or backward transfer limiter 21, is hydraulically connected via the means of local pressures balancing to the nearest cavity of the working chamber (2) of working part of the rotor 1 and the nearest supporting cavity 25 confined between the surfaces of the supporting end of supporting part of the rotor 4 and the surfaces of supporting cover plate of the housing 5.

The means of local pressures balancing are meant hereinafter to be a set of channels and cavities that being intercommunicated form a manifold of hydraulic circuits through which each of the force chambers of variable axial length is hydraulically connected to the cavity of said location in the working chamber and supporting cavity of said location. Thereby, from the point of view of hydraulic balancing of the working and supporting parts of rotor the pressure in the force chamber is substantially equal to the corresponding pressure in the cavities hydraulically connected to it at any angle of the rotor rotation and at any leaks from any cavity or force chamber that are admissible in terms of the volumetric efficiency of the hydraulic machine. Said channels and cavities can be made both in the rotor and in the housing. In the latter case the channels and the cavities of the housing are connected to the channels and cavities of the rotor during rotation of the rotor.

For the various embodiments of the machine with force closure to the housing described below the preferred embodiment of the invention provides for the means of local pressures balancing realized by the channels and cavities in the rotor FIG. 5*b*. In this case hydraulic circuit of the means of local pressures balancing includes channels in the working part of the rotor connecting annular groove 2 of working part of the rotor 1 with force chambers of variable axial length 6, for example, channels 18 in vanes 8, and vane chambers 7, directly connected to said force chambers 6, includes through channels 26 in force chambers 6 and also includes channels in supporting part of rotor 27 connecting force chambers 6 to supporting cavities 25.

For the various embodiments of the machine with force closure to the rotor described below the preferred embodiment of the invention provides for the means of local pressures balancing FIGS. 5*c*, 5*d*, 5*e* made as a combination of channels and cavities in the rotor with channels 27-1 and cavities 25 in the housing in this case connecting the annular groove of the working part of the rotor to the supporting cavities between supporting cover plate of the housing 5 and supporting part of the rotor 4.

In the preferred embodiment of the invention the mentioned supporting cavities 25 are made in supporting part of the rotor 4. In FIGS. 5*b*, 8*a*, 8*b* supporting cavities of the supporting part of the rotor are connected by means of channels 27 or 27-1 to force chambers 6 inside the rotor with channels 26 in connectors 12. Thus, the pressure in every supporting cavity is always equal to the pressure in the corresponding force chambers of variable axial length and to the pressure in the corresponding cavity of the working chamber of the working part of the rotor independently of the sealing surfaces defects, size of clearances in the end sealings and corresponding leakages from the supporting cavities and between them. Said leakages depend on the character of abutment of the surfaces of sliding insulating contact of the supporting cover plate of the housing to insulating means of the supporting cavities of the supporting part of the rotor. These insulation means of the supporting cavities include insulating dams 57 between the cavities; the character of their abutment to the supporting plate of the housing determines the leakages between supporting cavities, and peripheral end sealings 58; the character of their abutment to the supporting plate of the housing determines the leakages from the supporting cavities to the drainage FIG. 1*b*.

Location, form and area of supporting cavities 25 on the outer end of the supporting part of the rotor taking into account the area of the sliding insulating contact of the means of insulating supporting cavities with the supporting cover plate of the housing and pressure distribution in it are chosen so that the pressure forces acting on the supporting part of the rotor from force chamber of variable length are substantially balanced by the pressure from the supporting cavities leaving just a small pressing of the supporting part of the rotor to the corresponding sealing elements of the housing required for insulation. Thus, supporting cavities actually perform the role of unloading the supporting part of the rotor. The invention also provides for an embodiment with supporting cavities directly connected to the force chambers of variable length.

To provide the required for insulation pressing of the supporting part of the rotor to the supporting cover plate of the housing the total cross-section area of the force chambers of variable length exceeds the total area of the supporting cavities projection on the plane perpendicular to the axis of rotation of the supporting part of the rotor summed up with the total area of the insulation means of supporting cavities multiplied by the corresponding weight ratio determined by the average for rotor rotation angles area and character of abutment of the surfaces of sliding insulating contact of the supporting part of the rotor to the supporting plate of the housing equal, for example, to 50% in case of flat surfaces, like described above for the working part of the rotor. Minimum required area excess also depends on elasticity of the elastic elements of force chambers and described above friction forces that have to be overcome for necessary mutual movements of working and supporting parts of rotor.

For the embodiments of the machine as a hydromotor or a pump operating in a range of rotation speed and suction pressure generating no cavitation in vane chambers at the chosen type of vanes movement supporting cover plate can have no cavities. A variant of cover plate of the housing with distributing cavities to reduce a possibility of cavitation is described below.

The number of the supporting cavities in the supporting part of the rotor is equal or multiple of the number of vane chambers in the working part of the rotor.

In preferred embodiment the number of supporting cavities equal to the number of force chambers of variable length and to the number of vane chambers in the working part of the rotor, and the sum of the supporting cavity area and half of the area of the sliding insulating contact of the corresponding means of insulation with the supporting cover plate of the housing equal to the sum of the area of the opposite cavity formed in the annular groove of the working part of rotor in backward transfer zone and half of the area of the sliding insulating contact of the corresponding means of insulation with the working plate of the housing.

In particular case supporting part of the rotor has an annular groove and vanes located in vane chambers. The vanes closing the annular groove divide it into separate supporting cavities with local pressures balanced with local pressures in the corresponding cavities of the working chamber and force chambers of variable length by means of local pressures balancing.

In this case the surface of the supporting cover plate can include forward and backward transfer limiters. Then there is formed a second working chamber in the annular groove between the supporting part of the rotor and supporting cover plate of the housing. The mentioned second working chamber can be made either symmetrical to the first one as described in U.S. Pat. No. 3,348,494, or asymmetrically as described in RU2215903. In the latter case rotor machine has an opportunity of a reverse work, i.e. it can change the direction of the fluid flow without changing the direction of the input shaft rotation. The term symmetrically shall be considered with regard to the symmetry of the pressure forces at all the rotor positions. The second annular groove can differ in size from the first one provided the balance of the supporting part of the rotor described above. Means of insulation of supporting cavities include vanes with the surfaces sliding along the forward transfer limiter of the supporting cover plate of the housing and rotor means of insulation of backward transfer sliding along the backward transfer limiter of the supporting cover plate of the housing. Similar to the described above variants of the working part of the rotor the vanes of the supporting part of the rotor can have vane unloading cavities and vane sealing ledges while rotor means of backward transfer insulation can include either vanes or parts of annular groove bottom of the supporting part of the rotor with similar bottom unloading cavities and bottom sealing ledges.

For a machine with annular grooves and vane chambers in both parts of the rotor and with transfer limiters on the both cover plates of the housing the definitions "working" and "supporting" part with regard to the parts of the rotor are conventional and used for the unity of the terminology.

The invention also provides for an embodiment with more than one pair of the forward and backward transfer limiters on the working cover plate of the housing. Each pair of the limiters forms an additional pair of suction and pumping cavities in the annular groove connected to the input and output ports correspondingly. The vanes drive mechanism in such multicycle machine is made so that every vane performs as many relocation cycles relative to the annular groove during one rotation of the rotor as many pairs of the limiters on the working cover plate of the housing are made.

Multicycle embodiment is applicable to the machines described above with two annular grooves (in the working and supporting parts of rotor). In such machines the working and supporting cover plates of the housing have the same number of backward and forward transfer limiters. The invention provides for both symmetric and antisymmetric location of suction and pumping cavities formed in annular grooves of the working and supporting parts of rotor.

Thus for any character of abutment of the surfaces of the said sliding insulating contacts independent of the leakages determined by the said character of the sealing surfaces abutment, variable pressure forces of the working fluid acting on the working and supporting parts of rotor from the corresponding cover plates of the housing are substantially balanced by the same variable pressure forces of the working fluid acting from the force chambers. Minor pressing required for end sealing can be reasonably made very small.

Means of local pressures balancing implicate channels 27 with large flow area and small hydraulic resistance, which makes their obstructing with suspended particulate matters practically impossible and eliminates the influence of suspended particulate matters in the working fluid on the described balance of the pressure forces. In particular embodiment of the invention cross sectional dimensions of channels 27 are close to cross sectional dimensions of supporting cavities 25 or even equal to them.

Due to the mentioned properties of the means of local pressures balancing no matter how large is dispersion of the local pressures in different transferred volumes caused by local defects on the insulating surfaces resulting, for example, from wear, balancing of the rotor parts is not significantly disturbed.

One skilled in the art can find that removing the causes of significant imbalance results in significant reduction of the sliding insulating contacts area. In the preferable embodiment of the invention the total area of projection of the sliding insulating contact of insulating means of supporting cavities of the supporting part of the rotor with the supporting cover plate to the plane perpendicular to the rotor rotation axis is significantly smaller than the sum of the areas of the supporting cavities; and total area of projection of sliding insulating contact of the working part of the rotor with the working cover plate of the housing to the plane perpendicular to the rotor rotation axis is significantly smaller than the area of projection of the annular groove of the working part of rotor to the same plane. So, no matter how distribution of pressure changes in clearances of sliding sealing contacts of the parts of rotor with cover plates of the housing in case of local defects the influence of these changes on the balance of pressure forces acting upon every part of the rotor becomes insignificant.

Implementation of a distribution suction cavity in the supporting cover plate opposite the suction cavity lowers the tendency for cavitation as the mentioned distribution suction cavity provides hydraulic connection to the corresponding vane chamber with suction cavity 28 of the working chamber through other vane chambers or through channels in the rotor or in the housing. In suction cavity several vanes are at the same time at different stages of acceleration or slowdown FIG. 9. Vane chambers 7 in suction cavity are connected to the mentioned distribution suction cavity 28-1 through force chambers 6, that in their turn are connected by channels 27 to supporting cavities 25 of the supporting part of the rotor making a through hydraulic circuit. Hydraulic resistance of channels 27 and other components of the mentioned hydraulic circuit is low. So by means of the distribution suction cavity, channels 18 in these vanes in this case are connected in parallel. The fluid flows into the vane chamber of the vane with large axial speed not through the channels in that vane itself but through the channels in the vanes with low axial speed thus reducing pressure drop in the mentioned vane chamber. The degree of increasing of the maximum speed of self-suction in this case depends on the number of the vanes that are simultaneously in the suction cavity. If the channels are made in the rotor between the vanes rather than in vanes the effect of fluid redistribution flowing to vane chambers to replace protruding vanes through parallel channels and distributing cavity is the same. Increasing of the maximum self-suction speed by several times is an important advantage of the pumps with distributing cavity. Connection of the distributing cavity to the suction port by means of a channel in the housing further increases ultimate rotor rotation speed without cavitation. In case distributing pumping cavity is made opposite the pumping cavity and is connected by the channel in the housing to the pumping port hydraulic losses of the pump are decreased.

Another way to overcome tendency for cavitation and to increase ultimate self-suction speed is to change the type of vanes movement. If axial movement of the vane is replaced by vane rotation around some axis, for example, an axis parallel to the rotor rotation axis, this removes any need for vane channels or parallel channels as to inplace the turning vane the fluid flows round it in the vane chamber of large flow area without any significant pressure drop. To implement such a means it is more convenient to use hydromachines with force closure to the rotor rather than to the housing. More detailed description of the differences between these two types of architecture and a sample of implementing such vanes movement can be found below.

Force Closure to the Housing and Anti-Deformation Chambers.

The above description refers to the embodiments of rotor machine with the rotor made between the working and supporting face cover plates of the housing and the working chamber and supporting cavities made on external face surfaces of the rotor. Axial pressure forces of the working fluid acting upon the rotor and each part of the rotor, working and supporting, balance each other and compress each part of the rotor. Compression deformation can be ignored for steel works. Axial component of stretching pressure forces of the fluid in such machines is applied to the housing. Hereinafter such structures shall be called rotor machines with force closure to the housing.

Pressure forces acting upon each cover plate from inside the rotor machine are not balanced from outside by counter forces. At higher pumping pressures deformation of the cover plates and elements of the housing linking the cover plates starts to influence on the quality of face seals. To work with high pressures the invention provides for the hydrostatic means of preventing deformation of insulating surfaces of the cover plates of the housing.

In one embodiment of the mentioned hydrostatic means FIG. 10 face cover plates of the housing are made of two elements: external load-bearing element 29 taking upon itself pressure forces of the working fluid and internal functional element 30 being in sliding insulating contact with the corresponding part of the rotor. Anti-deformation chamber 31 connected to the pumping cavity via channel 32 is made between these elements opposite the pumping cavity. Form, dimensions and location of the anti-deformation chamber are chosen so that to compensate pressure forces of the fluid on internal functional element 29 of the cover plates of the housing from the side of the rotor by pressure forces of the fluid from the side of anti-deformation chamber 31. As a result external load-bearing element 29 of the cover plate takes upon the pressure forces and deformations caused by them. While internal functional element unloaded from pressure forces of the working fluid is not a subject to any deformations and keeps the form of the sealing surfaces and quality of the seals. Anti-deformation chamber 31 is sealed along the perimeter so that deformation of the load-bearing element 29 of the cover plate does not lead to leakages from this chamber.

The elements linking the cover plates of the housing in rotor machines with force closure to the housing can be made in two embodiments. The first embodiment provides for a linking element as a hollow body like a barrel with a space between the cover plate that contains a rotor inside FIGS. 2*a*, 2*b*. The invention also provides for a housing like a bobbin FIG. 2*c* where linking element 33 of the housing passes inside the rotor mounted on bearings 34 and located between face cover plates 3 and 5 of the housing, connected via tighten nuts 35 to linking element 33 of the housing.

Force Closure to the Rotor.

There is also another embodiment of the hydrostatic means for preventing deformations of the housing surfaces of the mentioned sliding insulating contacts for rotor machines with force closure to the rotor. As the rotor takes radial components of pressure forces of the working fluid in the annular groove it is made with sufficient solidity and rigidity.

Machines with force closure to the rotor provide for combination of the working and supporting cover plates of the housing into an operational unit of the housing located between the working and supporting parts of the rotor so that the working face surface of the working part of the rotor is in sliding insulating contact with the surface of the working cover plate of the operational unit of the housing and the surface of the supporting face of the supporting part of the rotor is in sliding insulating contact with the surface of the supporting cover plate of the operational unit of the housing.

Operational unit of the housing can be made as an integral part. In such an embodiment the function of the working cover plate is performed by that face surface of the operational unit that is in sliding insulating contact with the working face surface of the working part of the rotor, and the function of the supporting cover plate is performed by the opposite face surface of the operational unit being in sliding insulating contact with the surface of the supporting face of the supporting part of the rotor. Corresponding parts of such operational unit of the housing hereinafter shall be considered as working and supporting cover plates of the housing.

The invention provides that the assemblage of the rotor elements described above providing kinematical connection of the working and supporting parts of the rotor in such an embodiment includes a rotor linking element to which the stretching pressure forces of the working fluid tending to force out working and supporting parts of the rotor from the cover plates of the operational unit of the housing and from each other are transferred. The mentioned linking element may be connected to both parts of the rotor via force chambers of variable length or it can be connected via the mentioned force chambers to one of the parts of the rotor and rigidly coupled with the other part of the rotor.

In one of the embodiments of the invention the rotor has a form similar to a bobbin FIGS. 2*d*, 2*e*, 2*f*, 2*g* with two separated parts of larger diameter 36 connected by the medium part of smaller diameter of rotor linking element 37. The working chamber is located on the internal face surface of one or both parts of larger diameter.

Pumping and suction of the working fluid is realized through the channels in operational unit of the housing 38. There can be no suction channel for submersible embodiments of the pumps. External face surfaces of the operational unit perform the same functions as the internal functional elements of the working and supporting cover plates of the housing in the pumps with force closure to the housing. At least one of them carries a backward transfer limiter and forward transfer limiter on it.

In such an embodiment of the invention the rotor can be similarly made of two movable relative to each other parts: working part 1 containing vane chambers 7 with vanes 8 and annular groove 2, and supporting part 4 containing either supporting cavities 25 or also an annular groove and vanes for an embodiment with two working chambers. First of the mentioned parts of the rotor is rigidly coupled with the rotor linking element, for example, it is made as a rigid bobbin, and the second one is made as an annular element put on the medium part of the rotor linking element and connected via force chambers of variable length to the first one. FIG. 2*d* presents a machine with the working part of the rotor made as an annular element and FIG. 2*g*—with the supporting part of the rotor made as an annular element.

FIG. 2*e* presents an embodiment of the rotor with two working chambers in both parts of the rotor and two sets of vanes, one of the parts of the rotor made as an annular element. Both cover plates of the housing, that are both face surfaces of operational unit of the housing 38 have forward 15 and backward 21 transfer limiters. In this case the definitions "working" and "supporting" with regard to the parts of the rotor and cover plates of the housing are also relative and used to preserve common terminology.

FIG. 2*f* presents an embodiment of the rotor with separate carrying element 39 of the rotor made as a bobbin. Working 1 and supporting 4 parts of the rotor are mounted on the middle linking part of such carrying element. In this case force chambers of variable length 6 can be made between the internal faces of this third carrying element and both or one part of the rotor, either working or supporting.

Stretching components of the pressure forces of the working fluid in such machines are taken upon either by those parts of the rotor that are rigid enough or by those parts of the rotor which deformation do not influence on the leakages.

For the machines with force closure to the rotor it is difficult to use the supporting part of the rotor to exchange the working fluid between the working chamber and the vane chamber due to large length and complicated form of the inter-rotor channels required for that. Therefore it is convenient to overcome the tendency to cavitation in such machines by means of changing the character of vanes' movement and their form.

FIG. 2*g* presents an embodiment of the machine with the working part of the rotor made as a bobbin. To locate vanes drive mechanism in such a structure there may be used rear face of working part of the rotor 1 and adjacent part of the housing 40. Vanes 8 are located in vane chambers 7 of working part of the rotor 1 with a possibility to rotate around axis 41 parallel to axis 9 of the rotor rotation. Each vane has axial ledge 42 passing through the rear face of working part of the rotor 1. Axial ledge 42 has pivoted arm 43 sliding at the rotor rotation on cam guiding slot 44 and turning the vane so that in forward transfer area the vane shuts off annular groove 2, and in backward transfer area the vane is moved from the annular groove into vane chamber 7. Flow of the fluid generated by the turn of the vane does not induce any significant pressure drop capable of causing cavitation. The depth of the working chamber in such a structure can be increased that will lead to the increase of the displacement at the same dimensions. Increasing the ratio of the working chamber depth to the diameters of the sealing surfaces of the rotor and of the housing in its turn leads to the decrease of the share of the friction losses in total power and as a result to higher efficiency of hydro machine.

Operational unit of the housing of the machines with force closure to the rotor is under symmetrical compressing pressure forces of the fluid and is balanced in general that is an efficient means to prevent deformation of its surfaces of sliding insulating contacts. The type of its mounting on the housing should provide for a possibility of input-output of the fluid from the working chamber of the pump and it should prevent rotation of the operational unit relative to the housing around the axis of the rotor rotation (the housing itself can rotate relative to the rack of complete hydromechanical system).

To balance the pressure in the cavities between the operational unit of the housing and the parts of the rotor the machine shall have the channels connecting supporting cavities 25 of supporting part of the rotor 4, force chambers 6 inside the rotor, vane chambers 7 and cavities in the working chamber. These channels can be made in the rotor passing through the middle rotor linking part. The preferred embodiment of the machines with force closure to the rotor provides for channels 27-1 in operational unit of the housing 38, including forward transfer limiter and backward transfer limiter FIG. 5*c*-5*f*. In this case through channels 27-1 in operational unit of the housing 38 in transfer areas should be made so that to prevent the flow of the working fluid between the adjacent transferred volumes and suction and pumping cavities. It means that vane sealing ledges 17 or bottom sealing ledges 23 being in sliding insulating contact with the insulating surface of the corresponding transfer limiter should fully shut off the mentioned through channels 27-1 of operational unit 38 passing the corresponding spot, while the channel in forward 15 or backward 21 transfer limiter shut off by the surface of the vane 8 or of the bottom of annular groove 2 from the side of the working part of the rotor 1 is at the same time shut off by the sliding insulating contact of the surface of supporting part of the rotor 4 with supporting cover plate 5 of operational unit of the housing 38.

The invention also provides for such an embodiment of the machine with the force closure to the rotor where supporting cavities 25 are made not in the supporting face of supporting part 4 of the rotor but in the supporting cover plate of operational unit of the housing 38 FIGS. 5*c*, 5*e*, 5*f*. Means of the supporting cavities insulation in such an embodiment include partitions between the cavities in the housing the character of abutment of which to the supporting part of the rotor determines leakages between the supporting cavities, and also include peripheral insulating surfaces the character of abutment of which to the supporting part of the rotor determines the leakages from the supporting cavities to the drainage.

Location, form and area of these supporting cavities on the supporting cover plate of the operational unit of the housing taking into account the area of the sliding insulating contact of the means of insulation of the supporting cavities with the supporting part of the rotor and pressure distribution in it are chosen so that the pressure forces of the working fluid contained in force chambers of variable length tending to press the supporting part of the rotor to the supporting cover plate of the operational unit of the housing are substantially balanced by pressure forces from the side of the supporting cavities providing just a small pressing of the supporting part of the rotor to the corresponding sealing elements of the housing required for insulation.

Radial dimension of these cavities are chosen so that to provide the described substantial balancing of the supporting part of the rotor, and their arc dimensions are chosen so that to prevent leakages of the working fluid between the neighboring transferred volumes and suction and pumping cavities. It means that insulating surfaces of supporting part of the rotor 4 including dams between channels 27 (FIG. 5*e*) being in sliding insulating contact with the insulating surface of operational unit of the housing 38 should fully shut off the mentioned supporting cavities 25 of operational unit 38 passing the corresponding spot. In such an embodiment as presented in FIGS. 5*c*, 5*f*, the surface of the supporting face of supporting part of the rotor 4 can have no cavities. Mentioned supporting cavities 25 in the supporting cover plate of the operational unit of the housing are hydraulically connected via mentioned channels 27-1 to the adjacent by the angular distance cavities in the working chamber of working part of the rotor 1 so that each channel 27-1 made in forward 15 or backward 21 transfer limiter and shut off by the surface of vane 8 or of the bottom of annular groove 2 from the side of working part of the rotor 1 is connected to supporting cavity 25 that is at the same time shut off by sliding insulating contact of the surface of supporting part of the rotor 4 with supporting cover plate 5 of operational unit of the housing 38.

In a particular embodiment of the invention cross dimensions of channels 27-1 are close to cross dimensions of supporting cavities 25 or even equal to them FIG. 5*e*.

There is another possible embodiment of the machine with force closure to the rotor made not as a bobbin but as a hollow body (barrel) FIG. 2*h* with rotor linking element 37 containing the middle part made as hollow cylinder 45 connecting separate face parts 46 of the rotor so that inside the rotor there is formed a space with operational unit 38 of the housing mounted in it. In this case operational unit of the housing is mounted on the housing by means of shaft 47 with the axis passing through one of separate face parts 46 of the rotor. The offered solutions for such rotor are similar to those for rotor as a bobbin.

It is also possible to connect the supporting and working parts of the rotor directly by the set of force chambers of variable length 6 FIG. 2*i* made so that pressure forces of the working fluid contained in them tend to move working 1 and supporting 4 parts of the rotor closer to each other and to balance pressure forces forcing them out of operational unit 38 of the housing and from each other.

Due to described possibility of the force chambers of variable length to keep hermiticity at reciprocal movements of the parts of the rotor including the tilts, force chambers in the rotor of such machines, when it is mounted on the working or supporting part on the side opposite the operational unit of the housing, besides it's main functions also performs a function of preventing deformation of insulating surfaces of the corresponding part of the rotor under the influence of axial components of the pressure forces of the working fluid, similarly to anti-deformation chambers in the machines with force closure to the housing. So the pressure forces deform the external part of the rotor linking element which the force chambers are supported by, and which deformation is not significant for insulation.

Structures with force closure to the rotor result in the rotor complication but allow for significant simplifying and lightening of the housing structure. It can be of importance if such a structure is used, for example, as a pumping-motor unit in two-engine or multi-engine hydromechanical transmission where both the rotor and housing should rotate relative to the rack of the aggregate. The location of the vanes drive mechanism on the external face of the rotor and changing the character of vanes movement makes it possible to increase relative depth of the working chamber and efficiency of the machine and to remove the origins of cavitation in vane chambers.

The means of local pressures balancing in the described embodiments of the invention include a set of the channels in the rotor and in some embodiments they also include the channels in the housing, in particular, in the operational unit of the housing. Depending on the arrangement of the particular embodiment of the invention the mentioned set of the channels in the rotor includes either channels connecting force chambers of variable length to the annular groove of the working part of the rotor, or the channels connecting force chambers of variable length to the supporting cavities, or the channels connecting the supporting cavities to the annular groove of the working part of the rotor, or a combination of the listed channels. The mentioned channels in the rotor can include vane chambers, channels in the vanes and also channels in the force chambers.

The invention also provides for embodiments with the force chambers of variable length directly connected to the annular groove FIG. 5*f* or to the supporting cavities FIG. 2*j*. In the latter case there is provided an embodiment of the machine with force chambers of variable length 6 consisting of the containing elements in the form of force cavities 14 of working part of the rotor 1 directly connected to annular groove 2 of working part of the rotor 1, force cavities 14 of supporting part of the rotor 4 directly connected to supporting cavities 25 between supporting part of the rotor 4 and supporting cover plate 5 and embedded elements in the form of connectors 12 placed into the mentioned force cavities. In such an embodiment means of local pressures balancing include openings 48 FIG. 2*j* in the rotor formed at the mentioned direct connection of force chambers 6 to annular groove 2, channels 26 in connectors 12 and openings 48-1 formed at direct connection of force chambers 6 to supporting cavities 25. The means of local pressures balancing in the embodiment of such a machine with force closure to the rotor include openings 48 in the rotor formed at the mentioned direct connection of force chambers 6 to annular groove 2 and channels 27-1 in operational unit of the housing 38 connecting annular groove 2 to supporting cavities 25.

Summary of the Offered Solution.

Thereby, the essence of the described solutions removing the causes of dissipative energy losses on friction in face seals and on cavitation and making the pumps more reliable is as follows:

The rotor is made of two parts: working and supporting connected via force chambers of variable length so that the changing length of the force chambers results in little reciprocal axial movements and tilts of the working and supporting parts of the rotor required to provide their sliding insulating contact with the corresponding sealing surfaces of the working and supporting cover plates of the housing. There are supporting cavities made between the supporting part of the rotor and supporting cover plate of the housing.

Means of local pressures balancing provide for pressures in all force chambers equal to the pressures in the corresponding supporting cavities and cavities of the working chamber independently of the character of abutment of the surfaces of all sliding insulating contacts and leakages connected with it. Due to the choice of forms, dimensions and location of the force chambers and supporting cavities there is formed a close to reflection symmetric distribution of pressure forces acting upon the opposite faces of both parts of the rotor and thereby balancing each of the parts separately. The pressing of the parts of the rotor to the cover plates of the housing required to provide insulation in face seals and friction losses proportional to this pressing can be arbitrary small within a reasonable range. The mentioned equality of pressures determining this pressing is not disturbed by changing the character of abutment of the surfaces of sliding insulating contacts, in particular, by appearance of local defects of the sealing surfaces.

In this case one of the units, either rotor or stator (here mostly called the housing) is made so that to take upon itself stretching pressure forces of the working fluid, at the same time another unit takes upon itself compression pressure forces of the working fluid. The elements being deformed under the influence of axial pressure forces in the unit taking upon itself stretching pressure forces of the working fluid are separated by means of passing the pressure from the elements with flat surfaces providing a sliding insulating contact.

In the pumps with force closure to the housing suction of the fluid into the vane chambers and force chambers is provided via the channels in the supporting part of the rotor and distributing cavity in the supporting cover plate of the housing.

The mentioned channels have big flow section, cause no significant pressure drops with the fluid flow and are not subject to the influence of suspended particles.

External face of the rotor of the pump with force closure to the rotor can be used to allocate a vanes drive mechanism with rotating type of the vanes movement causing no significant pressure drops in the vane chamber.

Detailed Description of One Embodiment of the Offered Invention

To describe in details the structure and operation of one of the embodiments of the offered invention we shall consider an embodiment of a rotor sliding-vane machine with force closure to the housing in the form of a hollow cylinder (<<barrel>>) and with one working annular groove.

Rotor sliding-vane machine in the present embodiment of the invention FIGS. 1*a*, 1*b*, 2*a*, 2*b*, 9 and 10 comprises two main units: the housing and the rotor installed inside the housing with a possibility of rotation.

The rotor contains working part 1 with vane chambers 7 with annular groove 2 of constant rectangular cross-section made on the working face surface of the said part and connected to vane chambers 7 holding vanes 8 with through channels 18.

Housing 40 is made with inlet 49 and outlet 50 ports and with face working 3 and supporting 5 cover plates each consisting of load-bearing element 29 and internal functional element 30, there are also anti-deformation chambers 31 connected to outlet port 50 and made between the mentioned load-bearing and functional elements, and suction 28-1 and pumping 51-1 distributing cavities divided by insulating dams (57) made on the functional element of the supporting cover plate.

The working chamber of the machine is bounded in radial direction by the internal surfaces of annular groove 2, and in axial direction by the internal surface of working cover plate 3 of the housing and by bottom of annular groove 20. In the working chamber there are forward transfer limiter 15, backward transfer limiter 21, and there are formed suction cavity 28 connected to inlet port 49, and pumping cavity 51 connected to outlet port 50. Suction and pumping cavities are connected to the inlet and outlet ports correspondingly via channels 52, 53 in working cover plate 3 of the housing.

To consider the processes occurring in the machine during the transfer of the working fluid there are recognized four areas: suction area A, forward transfer area B, pumping area C and backward transfer area D.

Suction area A corresponds to the location of suction cavity 28, and pumping area C corresponds to the location of pumping cavity 51. Forward transfer area B is located between suction A and pumping C areas. In this area the fluid contained in the working chamber between vanes 8 and in the rotor cavities connected to the working chamber is transferred from suction area A to pumping area C. In backward transfer area D part of the fluid from pumping area C is transferred back to suction area A.

Forward transfer limiter 15 is mounted on the working cover plate of the housing, located in the working chamber in forward transfer area B and is in sliding contact with the face surfaces of vanes 8 moving into annular groove 2, thereby providing a possibility of separating at least one inter-vane cavity 62 by the vanes from suction cavity 28 and from pumping cavity 51.

In other embodiments of the present invention the mentioned limiter can be made movable in axial direction. In case of its axial movement the area of the cross-section of the working chamber in forward transfer area changes and therefore changes the displacement of the machine. To control its axial movement the machine should have a drive mechanism of the forward transfer limiter. In the machine of the fixed displacement the mentioned forward transfer limiter can be made as flat insulating spot on the working cover plate of the housing.

Backward transfer limiter 21 is mounted on working cover plate 3 of the housing, located in the working chamber in backward transfer area D, contacts with sliding with the rotor means of insulation of the backward transfer, namely with the internal surfaces of annular groove 2, and thereby separates suction cavity 28 and pumping cavity 51 of the working chamber.

Vanes drive mechanism 54 is made as a cam mechanism including mounted on housing 40 carrier 55 of guide cam slot 44 in which side lobes 56 of vanes 8 slide. Profile of the cam slot determines the character of the axial movement of the vanes at the rotation of the rotor. Vanes drive mechanism controls cyclical movement of vanes 8 relative to working part 1 of the rotor at its rotation so that vanes 8 in suction area A axially move out of vane chambers 7 into annular groove 2 and in forward transfer area B shut off cross section of the working chamber, and in pumping area C move out of annular groove 2 into vane chambers 7 and open cross section of the working chamber in backward transfer area D.

Forward transfer limiter 15 is provided with an unlocking section with slot 63 FIG. 1*b*. Dimensions and location of the slot are chosen so that to provide pressure balancing at the faces of the vane by the beginning of its axial movement out of the annular groove into the vane chamber.

Other embodiments of the present invention can have a different character of the vanes' movement. Any kinds of the vanes' movement relative to the rotor leading to cyclical change of the degree of shutting off the cross section of the annular groove by the vane are admissible. For example, besides structures with axial movement there may be structures with radial movement of the vanes, with rotary movement and with their combination. In the pumps with variable displacement the mentioned mechanism should be kinematically connected to axially movable forward transfer limiter in order to provide the change of the degree of the vanes moving out of the vane chambers to the annular groove corresponding to the change of the area of cross section of the working chamber in forward transfer area.

The rotor also comprises supporting part 4 FIG. 1*b* with supporting cavities 25 on the external face. The mentioned supporting cavities are insulated by flat surfaces of means of the supporting cavities insulation, namely, insulating dams 57 and peripheral face seals 58, due to the sliding insulating contact of the mentioned flat surfaces with flat insulating surfaces of functional element 30 of supporting cover plate of the housing 5.

The mentioned working and supporting parts of the rotor are mounted on bearings 34 on working 3 and supporting 5 cover plates of the housing correspondingly and connected to inlet shaft 60 by means of joints 61 so that they rotate synchronously but have a possibility to make little axial movements and tilts relative to each other at least sufficient for providing sliding insulating contact of the both mentioned parts of the rotor with the corresponding cover plates of the housing.

The rotor also comprises force chambers of variable length 6 located between working part of the rotor 1 and supporting part of the rotor 4. The mentioned force chambers in the present embodiment of the machine are formed by force cavities 14 made on the surfaces of working 1 and supporting 4 parts of the rotor looking at each other and cannular connectors 12 mounted with possibility of sliding in the mentioned force cavities. Cannular connectors have sealing shoulders 13. Their form, location and dimensions are chosen so that to provide insulation of force chambers within the whole range of axial movements and tilts of the supporting part of the rotor relative to the working part of the rotor. There are springs 59 installed in force chambers of variable length to provide sealing in case of no pressure. The same change of the length of all force chambers 6 leads to forward reciprocal movement of working 1 and supporting 4 parts of the rotor while different change of the length of different force chambers 6 leads to reciprocal tilts of working 1 and supporting 4 parts of the rotor.

Means of local pressures balancing in the present embodiment of the machine include vane chambers 7 and channels 18 in the vanes via which each of the mentioned cavities of the working chamber 28, 51 and 62 is connected to force cavities 14 of working part of the rotor, channels 27 via which force cavities 14 of the supporting part of the rotor are connected to supporting cavities 25, and channels 26 in connectors 12. The mentioned channels have small hydraulic resistance so that at flow rate of the working fluid through any of the mentioned channels corresponding to maximum admissible leakage from the working chamber the pressure drop in this channel is substantially, i.e. hundreds times less than nominal pumping pressure. So from the point of view of the balance of pressure forces acting upon the parts of the rotor at any angle of the rotor rotation the local pressures in the supporting cavity and in the force chamber and cavity in the working chamber connected to it are substantially equal at any admissible level of the leakages from any mentioned cavity.

The faces of the vanes moving into the annular groove have vane sealing ledges 17 shutting off inter-vane cavities of forward transfer 62 at sliding contact with the forward transfer limiter.

The bottom 20 of annular groove 2 has bottom sealing ledges 23 that at sliding contact with the backward transfer limiter are shutting off bottom unloading cavities 22 connected to force chambers 6 via channels 18 in the vanes and vane chambers 7. The area of the sliding surface of bottom sealing ledge 23 in the present embodiment of the machine is equal to the area of the sliding surface of vane sealing ledge 17.

The number of supporting cavities 25 is equal to the number of vane chambers 7. Supporting cavities 25 are oval, their radial width is equal to the radial width of annular groove 2. Sum of the areas of supporting cavities 25 and dams 57 is equal to the area of the bottom of annular groove 2. At that the areas of the sliding surfaces of dams 57 are equal to the areas of sliding surfaces of bottom sealing ledges 23, and the areas of sliding insulating contacts of peripheral face seals 58 with insulating surfaces of supporting cover plate of the housing 5 are equal to the corresponding areas of sliding insulating contacts of working part of the rotor 1 with working cover plate of the housing 3. Supporting cavities 25 are located opposite annular groove 2, and dams 57 are located opposite bottom sealing ledges 23.

The number of force chambers of variable length 6 is equal to the number of vane chambers 7. Cross section of force chambers of variable length 6 has round shape. The sum of cross sections of force chambers 6 exceeds the sum of the area of the bottom of annular groove 2 and half of the area of the sliding insulating contact of the working part of the rotor with the working cover plate of the housing by the value sufficient for small, enough for insulation, pressing of working 1 and supporting 4 parts of the rotor to the corresponding cover plates of the housing 3 and 5.

Operation of the Described Embodiment of the Machine

Let us consider the operation of the rotor sliding-vane machine described above operating as a pump and the balance of pressure forces of the working fluid acting upon the working and supporting parts of the rotor. The same arguments are valid for a hydromotor amended for the difference in hydro tightening of the vanes described above. To consider a complete cycle consisting of suction, forward transfer, pumping and backward transfer we shall consider single transferred volume formed by the cavities connected at the transference to the vane chamber of one chosen vane. The initial moment of consideration corresponds to the position of the chosen vane at the beginning of the suction area. Balance of the forces acting upon the parts of the rotor shall be considered based on the steady-state local pressures in the cavities of the transferred volume and in the sealing clearances adjacent to it. The present pump operates as follows:

At the initial moment of the cycle equal to one turn of the rotor the chosen vane is located on the border of the backward transfer area and suction area.

When input shaft 60 FIG. 2*a* is rotating the torque is transferred via joints 61 to working 1 and supporting 4 parts of the rotor causing their rotation relative to housing 40.

At the rotation of the rotor FIGS. 1*a*, 2*b*, 9 side lobe 56 of vane 8 slides along the guide cam slot 44 of such a form that in suction area A the vane moves out of vane chamber 7 into annular groove 2. The working fluid via channel 52 and suction distributing cavity 28-1 in supporting cover plate 5, supporting cavity 25 and channel 27 in the supporting part of the rotor, and via cannular connector 12 in force chamber 6 fills up the space in vane chamber 7 vacated by the moving vane 8. Besides that, part of the fluid goes to the vacated volume in the vane chamber via channel 18 FIG. 9 in vane 8 and via similar channels in other vanes connected to the suction distributing cavity. The mentioned fluid filling up the space in the vane chamber 7 vacated by the vane 8 moving out of the vane chamber compensates the volume replaced by the part of the vane 8 in annular groove 2. Presence of distributing cavity 28-1 in supporting cover plate 5 of the housing and of channels 52 and 27 decreases hydraulic resistance of the duct via which the fluid fills up the vane chamber 7 at the vane 8 moving out, decreasing in that way the tendency of the pump to cavitation and makes it possible to increase maximum self-suction speed.

While the working fluid in the force chamber is under low or zero pressure the force cavities of the force chamber are slided apart by the springs 59 FIG. 2*a*. Protruded vane in forward transfer area B contacts with sliding by its sealing ledge 17 to forward transfer limiter 15 and closes from behind inter-vane cavity 62 FIG. 9 of forward transfer that is shut off by the sealing ledge of the previous vane 8' from the front in the direction of the rotor rotation. Insulating dam 57 of the supporting part of the rotor in forward transfer area has a sliding contact with flat insulating dam 64 of the supporting cover plates of the housing and closes from behind the supporting cavity 25 that is shut off by the previous dam 57' from the front in the direction of the rotor rotation. The insulation of force chamber of variable length 6 is provided by sealing shoulders 13 of cannular connector 12. So current transferred volume 65 including the volumes of inter-vane cavity 62, channel 18 in vane 8, vane chamber 7, cavities 14 and channel 26 of force chamber 6, channel 27 and supporting cavity 25 in supporting part of the rotor 4 becomes closed in the forward transfer area.

At the rotor rotation this current transferred volume 65 travels in forward transfer area B from suction area A to pumping area C. Due to the inter-leakage of the working fluid between the adjacent transferred volumes as the mentioned transferred volume travels towards the pumping area the pressure in it increases. The character of the pressure increase depends on the speed of rotor rotation, outlet pressure, character of abutment of the surfaces of insulating contacts, i.e. clearances between all sealing surfaces in the forward transfer area and presence of local defects on them and can be different for different transferred volumes. But due to the means of local pressures balancing as a manifold of channel 18 in vane 8, channel 27 in the supporting part of the rotor and channel 26 in cannular connector 12 the pressure in all the mentioned cavities 62, 18, 7, 14, 27 and 25 forming the chosen transferred volume, is the same. As the pressure of the fluid in force chamber 6 included into the considered transferred volume increases the forces of hydrostatical pressure of the fluid become more important in the balance of the forces acting upon the working and supporting parts of the rotor and the role of springs 59 FIG. 2*a* becomes less significant. Dimensions of annular groove 2, area of the sliding insulating contact of the working part of the rotor with the working cover plate of the housing determined in this case by the width of sealing shoulders 66 FIG. 1*b* of the working cover plate of the housing, and dimensions of force chambers 6 are chosen so that pressure forces of the fluid acting upon the working part of the rotor from the side of inter-vane cavities 62 are smaller than the pressure forces from the side of force chambers 6 by a small chosen value in order to provide minimum required pressing of working part of the rotor 1 to working cover plate of the housing 3. The mentioned value of the pressure forces difference is chosen taking into account friction forces in the force chambers and in the joint couplings of the parts of the rotor with the shaft. Similarly, dimensions and form of supporting cavities 25 of supporting part of the rotor 4 and dimensions of sealing shoulders 67 FIG. 1*a* of supporting cover plate of the housing 5 are chosen so that pressure forces of the fluid acting upon the supporting part of the rotor from the side of supporting cavities 25 are smaller than the pressure forces from the side of force chambers 6 by a small chosen value in order to provide minimum required pressing of supporting part of the rotor 4 to supporting cover plate of the housing 5. Mutual location of inter-vane cavities 62, force cavities 14 and supporting cavities 25 is chosen so that the moments of the counter pressure forces of the working fluid acting upon the working and supporting parts of the rotor are minimized. Therefore pressure forces acting upon the working part of the rotor from the side of inter-vane cavities and from the side of the force chambers are substantially balanced, i.e. mutually balance each other except a small pressing required for duly face sealing from the side of the force chambers to the working cover plate of the housing. Pressure forces acting upon the supporting part of the rotor from the side of the supporting cavities and from the side of the force chambers are substantially balanced in a similar way.

At the end of the forward transfer area sealing ledge 17 of the previous vane 8' moves to the unlocking section of forward transfer limiter 15. At the same time the previous partition 57' of supporting cavity 25 of the chosen transfer volume is shifted from insulating dam 64 to the zone of pumping distributing cavity 51-1 of supporting cover plate of the housing 5. Here the chosen transferred volume is connected to the pumping area.

Passing pumping area C all the cavities of the chosen transferred volume and insulating dams between supporting cavities 25 of supporting part of the rotor 4 are under pumping pressure. Due to the aforesaid properties of force chambers 6 and supporting cavities 25 and sealing shoulders 67 and 66 FIGS. 1*a*, 1*b* on supporting 5 and working 3 cover plates of the housing, pressure forces acting upon the working part of the rotor from the side of inter-vane cavities 62 and from the side of force chambers 6 as well as pressure forces acting upon supporting part of the rotor 4 from the side of supporting cavities 25 and from the side of force chambers 6 in pumping area C also mutually balance each other except for a minimum required pressing of the parts of the rotor to the corresponding cover plates of the housing.

Due to such mutual balancing the working and supporting parts of the rotor are not subject to axial deformations and keep flat form of the sealing surfaces.

Pressure forces of the fluid are transferred via anti-deformation chambers 31 to external load-bearing elements 29 of the working and supporting cover plates of the housing as their deformation influences the leakages less than the deformation of the corresponding functional elements 30. Such functional elements take just a minor part of pressure forces required for pressing to the load-bearing element. Their sealing surfaces remain flat and provide for insulation.

As the chosen vane passes pumping area side lobe 56 of the vane slides along guide cam slot 44 of such a form that the vane in pumping area C moves out from annular groove 2 into vane chambers 7. At this time the working fluid via channels 18 in vanes 8 and via channels 26 in cannular connectors 12 is displaced to outlet port 50 from the space in vane chamber 7 occupied by the moving out vane 8 compensating the volume vacated by the vane in the annular groove. Therefore, the pump displacement does not depend on the vane size.

Coming to backward transfer area D the chosen vane moves into the vane chamber completely. Bottom sealing ledges 23 in annular groove 2 adjacent the chosen vane from the front and from behind relative to the direction of the rotor rotation move from the pumping area to the backward transfer area and form a sliding contact with the surface of the backward transfer limiter there, thus closing bottom cavity in the annular groove. Insulating dam 57 of supporting part of the rotor 4 is in sliding contact with flat insulating dam 64 of the supporting cover plate of the housing in the backward transfer area and closes from behind supporting cavity 25 closed from the front at the direction of the rotor rotation by the previous insulating dam 57'. The insulation of force chamber of variable length 6 is provided by sealing shoulders 13 of cannular connector 12. Thereby, recurrent backward transfer volume 68 including the volumes of bottom unloading cavity 22, channel 18 in vane 8, vane chamber 7, cavities 14 and channel 26 of force chamber 6, channel 27 and supporting cavity 25 in supporting part of the rotor 4 is closed in the backward transfer area.

At the rotation of the rotor this current backward transfer volume 68 moves in backward transfer area D from pumping area C to suction area A. Due to the inter-leakage of the working fluid between adjacent transferred volumes as the mentioned transferred volume travels towards the suction area the pressure in it decreases. The character of the pressure drop depends on the speed of the rotor rotation, difference of the pumping and suction pressure, character of abutment of the surfaces of insulating contacts, i.e. clearances between all sealing surfaces in the backward transfer area and presence of local defects on them, and it can be different for different transferred volumes. But due to the means of local pressures balancing as a manifold of channel 18 in vane 8, channel 27 in the supporting part of the rotor and channel 26 in cannular connector 12, the pressure in all the mentioned cavities 22, 18, 7, 14, 27 and 25 forming the transferred volume is the same.

Due to the aforesaid properties of force chambers 6 and supporting cavities 25 in supporting part of the rotor 4, and sealing shoulders 67 on supporting cover plate of the housing 5, pressure forces acting upon supporting part of the rotor 4 from the side of supporting cavities 25 and from the side of force chambers 6 in backward transfer area D also mutually balance each other except for a minimum required pressing of the supporting part of the rotor to the supporting caver plate of the housing.

Sizes of bottom sealing ledges 23, sealing shoulders 66 of the working cover plate of the housing and force chambers 6 are chosen so that pressure forces of the fluid acting upon the working part of the rotor from the side of bottom unloading cavities 22 are smaller than the pressure forces from the side of force chambers 6 by a small chosen value in order to provide minimum required pressing of the working part of the rotor to working cover plate of the housing 3. Mutual location of bottom unloading cavities 22 and of force cavities 14 is chosen so that the moments of the said counter pressure forces of the working fluid acting upon the working part of the rotor are minimized.

Therefore, no matter in which area of the working chamber the chosen vane is, the pressures in its vane chamber and in the force chamber and the supporting cavity of the supporting part of the rotor connected to its vane chamber are equal to the pressure in that cavity of the working chamber which they are connected to via the channel in the vane.

Forms, size and location of force cavities of the force chamber and supporting cavity taking into account the means of insulation of the supporting cavity are chosen so that at the mentioned equality of pressures the forces acting upon each part of the rotor from the side of the force chambers exceed the forces acting upon it from the side of the corresponding cover plate of the housing by a value required for pressing of the sealing surfaces of this part of the rotor to the sealing surfaces of the functional element of the corresponding cover plate of the housing.

Friction losses of power in the face sealings are determined by the mentioned value of the force of pressing of the parts of the rotor to the functional elements of the corresponding cover plates of the housing that can be chosen small. Appearance of local defects on the sealing surfaces due to wear, for example, and contamination of the working fluid with the suspended particles do not lead to increase of the mentioned force of pressing. Hydraulic resistance of the channels determining pressure drop in the vane chamber and maximum self-suction speed can be chosen on the basis of the required working speed of the rotor rotation.

The invention claimed is:

1. A rotor sliding-vane machine with adaptive rotor comprising:

a housing with an inlet port, an outlet port, a supporting cover plate and a working cover plate having a forward transfer limiter and a backward transfer limiter;

a rotor, comprising a working part of the rotor with vane chambers, while a working face surface of said working part of the rotor has an annular groove connected to vane chambers containing vanes that are kinematically connected to a vanes drive mechanism mounted on the housing;

while the working cover plate of the housing being in sliding sealing contact with the working face surface of the working part of the rotor forms a working chamber in the annular groove, so that the working chamber is divided by the backward transfer limiter being in sliding sealing contact with a rotor means of backward transfer insulation and by the forward transfer limiter being in the sliding sealing contact with the vanes into: a suction cavity of the working chamber hydraulically connected to the inlet port and a pumping cavity of the working chamber hydraulically connected to the outlet port, while the forward transfer limiter and the vanes drive mechanism are made so that the vanes separate at least one inter-vane cavity of the working chamber from the pumping and suction cavities, wherein the rotor also comprises: a supporting part of the rotor being in sliding sealing contact with the supporting cover plate of the housing and kinematically connected to the working part of the rotor by an assemblage of rotor elements, including force chambers of variable length so that to rotate synchronously with the working part of the rotor allowing axial travels and tilts relative to the working part of the rotor to provide a sliding sealing contact of both the working part and the supporting part of the rotor with the corresponding cover plates of the housing, while changing the length of the force chambers of variable length leads to said axial travels and tilts of the working and supporting parts of the rotor, while supporting cavities provided with sealing means are made between the supporting cover plate of the housing and supporting part of the rotor, while each of the said cavities of the working chamber hydraulically communicates with at least one force chamber of variable length and with at least one supporting cavity via means of local pressures balancing.

2. The machine according to claim 1, wherein the housing comprises hydrostatic means for preventing deformation of an sealing surfaces of the cover plates by joining the working and supporting cover plates of the housing into an operational unit of the housing located between the working and supporting pans of the rotor.

3. The machine according to claim 2, wherein the rotor includes a rotor linking element, while at least one of said working and supporting parts of the rotor is mounted to said linking element allowing axial travels and tilts relative to said linking element, while the force chambers of variable length are located between said at least one of said parts of the rotor and said rotor linking element and kinematically connect said at least one of said parts of the rotor to said linking element.

4. The machine according claim 1, wherein the housing comprises hydrostatic means for preventing deformation of sealing surfaces of the cover plates, while said hydrostatic means include:

a functional element and a load-bearing element of at least one of the cover plates of the housing, while said functional element is in sliding sealing contact with the corresponding part of the rotor, at least one anti-deformation chamber located between the functional and load-bearing elements, hydraulically connected to the working chamber, balancing the working fluid pressure forces exerted against the functional element from the side of the anti-deformation chamber with working fluid pressure forces exerted against the functional element from the side of the rotor.

5. The machine according to claim 4, wherein the rotor is located between the working and supporting cover plates of the housing connected by a housing linking element, while the supporting cavities are made in the supporting part of the rotor, while the means of local pressures balancing include channels in the supporting part of the rotor connecting the supporting cavities to the force chambers of variable length connected to the vane chambers, while the supporting cover plate of the housing has at least one suction distributing cavity hydraulically connected to the inlet port and located opposite the suction cavity of the working chamber so that it communicates with the supporting cavities of the supporting part of the rotor.

6. The machine according to claim 5, wherein the supporting cover plate of the housing has at least one pumping distributing cavity hydraulically connected to the outlet port and located opposite the pumping cavity of the working chamber so that it is connected to the supporting cavities of the supporting part of the rotor.

7. The machine according to claim 1, wherein the means of local pressures balancing are formed by a manifold of hydraulic circuits in the rotor providing connection of each of said cavities of the working chamber with the at least one force chamber of variable length and at least one supporting cavity.

8. The machine according to claim 1, wherein the means of local pressures balancing are formed by a manifold of hydraulic circuits in the rotor and a manifold of hydraulic circuits in the housing, while each of said hydraulic circuits in the rotor communicates with at least one of said hydraulic circuits in the housing at any angle of the rotor rotation providing connection of each of said cavities of the working chamber with the at least one force chamber of variable length and at least one supporting cavity.

9. The machine according to claim 7 or 8, wherein the manifold of hydraulic circuits in the rotor includes channels in the supporting part of the rotor connecting the force chambers of variable length to the supporting cavities.

10. The machine according to claim 7 or 8, wherein the manifold of hydraulic circuits in the rotor includes the vane chambers.

11. The machine according to claim 7 or 8, wherein the manifold of hydraulic circuits in the rotor includes channels in the vanes.

12. The machine according to claim 8, wherein the manifold of hydraulic circuits in the housing includes channels in the housing connecting the supporting cavities to the annular groove in the working part of the rotor.

13. The machine according to claim 7 or 8, wherein each of said circuits has hydraulic resistance chosen so that the pressure drop in it is substantially less than nominal operational pressure of the machine at the rate of the working fluid flow through it being less than maximum admissible leakage from the working chamber, preferably said pressure drop is less than 1% of the nominal operational pressure.

14. The machine according to claim 1, wherein the force chambers of variable length are formed by containing elements and embedded elements mounted to allow reciprocal movement, while the outer walls of the embedded elements are in sliding sealing contact with the inner walls of the containing elements providing sealing of the force chambers at said reciprocal axial travels and tilts of the working and supporting parts of the rotor.

15. The machine according to claim 1, wherein forms, dimensions and location of the supporting cavities and their means of sealing are chosen so that the working fluid pressure forces that repel the working part of the rotor from the working cover plate of the housing are substantially equal and directed opposite to the working fluid pressure forces that repel the supporting part of the rotor from the supporting cover plate of tile housing, while forms, dimensions and location of the force chambers of variable length are chosen so that the excess of pressure forces of the working fluid contained in the force chambers of variable length acting on said parts of the rotor over the working fluid pressure forces that repel said parts of the rotor from corresponding cover plates of the housing is at least sufficient for providing tightening required for sealing, preferably minimal tightening, at any angle of the rotor rotation.

16. The machine according to claim 1, wherein forms, dimensions and location of the supporting cavities and their means of sealing are chosen so that the working fluid pressure forces that repel the working part of the rotor from the working cover plate of the housing are substantially equal and directed opposite to the working fluid pressure forces that repel the supporting part of the rotor from the supporting cover plate of the housing, while said assemblage of rotor elements further comprises elastic elements providing tightening required for sealing of said working and supporting parts of the rotor to the corresponding cover plates of the housing at no pressure, while forms, dimensions and location of the force chambers of variable length are chosen so that the excess of the sum of elasticity forces of the said elastic elements and the pressure forces of the working fluid contained in force chambers of variable length acting on said working and supporting parts of the rotor over the sum of working fluid pressure forces that repel said working and supporting parts of the rotor from the corresponding cover plates of the housing and friction forces in said assemblage of rotor elements is at least sufficient for providing tightening required for sealing, preferably minimal tightening, at any angle of the rotor rotation.

17. The machine according to claim 15 or 16, wherein the supporting cavities are located opposite the annular groove, the sealing means of the supporting cavities include peripheral face seals and sealing dams between the supporting cavities, while the sum of the areas of the supporting cavities and sealing dams is equal to the area of projection of the annular groove to the plane perpendicular to the axis of rotation of the working part of the rotor, while the areas of sliding sealing contacts of the peripheral face seals with the sealing surfaces of the supporting cover plate of the housing are equal to the corresponding areas of sliding sealing contacts of the working part of the rotor with the working cover plate of the housing.

18. The machine according to claim 15 or 16 wherein the rotor means of backward transfer insulation include the pans of the annular groove bottom surface between the vanes including bottom unloading cavities separated from at least one of two adjacent vane chambers by bottom sealing ledges being in sliding sealing contact with the backward transfer limiter, while the sealing dams are located opposite the bottom sealing ledges and the areas of the sliding surfaces of the sealing dams are equal to the areas of the sliding surfaces of the bottom sealing ledges.

19. The machine according to claim 1, wherein form and dimensions of the force chambers of variable length are chosen so that the excess of the sum of cross-sectional areas of all force chambers of variable length over the area of projection of the annular groove to the plane perpendicular to the axis of rotation of the working part of the rotor is not less than 50% of the area of sliding sealing contact of the working part of the rotor with the working cover plate of the housing.

20. The machine according to claim 1, wherein surface of the supporting cover plate of the housing being in sliding contact with the supporting part of the rotor, opposite the forward and backward transfer limiters of the working cover plate of the housing has a forward and a backward transfer limiters of the supporting cover plate of the housing, while a face of the supporting part of the rotor being in sliding contact with the supporting cover plate of the housing has an annular groove connected to the vane chambers of the supporting part of the rotor, while the means of supporting cavities insulation include the vanes located in said vane chambers and kinematically connected to the vanes drive mechanism so that they are in sliding sealing contact with said forward transfer limiter of the supporting cover plate of the housing.

21. The machine according to claim 20, wherein the means of the supporting cavities insulation include parts of the annular groove bottom between the vanes being in sliding sealing contact with said backward transfer limiter of the supporting cover plate of the housing.

22. The machine according to claim 20, wherein the means of the supporting cavities insulation include vanes located in vane chambers of the supporting part of the rotor and kinematically connected to the vanes drive mechanism so that said vanes are in sliding sealing contact with said backward transfer limiter of the supporting cover plate of the housing.

23. The machine according to claim 1, wherein the rotor means of backward transfer insulation include parts of the annular groove bottom between the vanes.

24. The machine according to claim 21 or 23, wherein said parts of the annular groove bottom have bottom unloading cavities separated from at least one of two adjacent vane chambers by bottom sealing ledges being in sliding sealing contact with said backward transfer limiter.

* * * * *